US007726264B2

(12) United States Patent
Kawaguchi et al.

(10) Patent No.: US 7,726,264 B2
(45) Date of Patent: Jun. 1, 2010

(54) METHOD OF INSTALLING FURNACE WALLS OF A BOILER

(75) Inventors: Shigeyoshi Kawaguchi, Chiyoda-ku (JP); Motoshi Horinouchi, Chiyoda-ku (JP); Shinichi Sagawa, Chiyoda-ku (JP); Yoshitaka Masuda, Chiyoda-ku (JP); Masakatsu Imamura, Kure (JP); Tadayoshi Mariyama, Kure (JP); Yasuaki Kawashima, Kure (JP)

(73) Assignees: Hitachi Plant Technologies, Ltd., Tokyo (JP); Babcock-Hitachi Kabushiki Kaisya, Kure-shi (JP)

( * ) Notice: Subject to any disclaimer, the term of this patent is extended or adjusted under 35 U.S.C. 154(b) by 0 days.

(21) Appl. No.: 11/733,377

(22) Filed: Apr. 10, 2007

(65) Prior Publication Data

US 2007/0272172 A1 Nov. 29, 2007

(30) Foreign Application Priority Data

May 29, 2006 (JP) ..... 2006-148641

(51) Int. Cl.
*B21D 51/24* (2006.01)

(52) U.S. Cl. ..... 122/450; 122/493; 29/890.051

(58) Field of Classification Search ..... 29/890.051; 122/493, 496, 512, 450
See application file for complete search history.

(56) References Cited

U.S. PATENT DOCUMENTS 2,775,810 A * 1/1957 Galehouse ..... 269/17
4,910,848 A * 3/1990 Spada et al. ..... 29/890.051
7,275,503 B2 * 10/2007 Waseda et al. ..... 122/7 R
2001/0023665 A1 * 9/2001 Heidrich ..... 122/510

FOREIGN PATENT DOCUMENTS

| | | | |
|---|---|---|---|
| JP | 05-240405 | | 9/1993 |
| JP | 05240405 | A * | 9/1993 |
| JP | 05306802 | A * | 11/1993 |
| JP | 06288505 | A * | 10/1994 |
| JP | 06323503 | A * | 11/1994 |
| JP | 2002213707 | A * | 7/2002 |
| JP | 2006162137 | A * | 6/2006 |
| JP | 2007107787 | A * | 4/2007 |

* cited by examiner

*Primary Examiner*—Gregory A Wilson
(74) *Attorney, Agent, or Firm*—Oliff & Berridge, PLC

(57) ABSTRACT

New and useful method of installing furnace walls for a boiler that does not require dedicated temporary lifting mechanism and reduces the installation work period significantly is disclosed. The method of installing furnace walls for a boiler configured with an upper portion of boiler proper 30 and a lower portion of boiler proper 40, temporally suspending two left and right face furnace water wall panels 48 among four furnace water wall panels, the upper portion of boiler proper is assembled while it is hanged from a top girder module 28 positioned on the top portion of a center portion in a boiler frame, a furnace rear wall 44 and a furnace front wall 42 among the furnace water wall panels are hanged sequentially, the temporally suspended two left and right face furnace water wall panels 48 are moved to designated positions, and the upper ends of the furnace water wall panels 48, 44 and 42 are connected with the lower end of the upper portion of boiler proper 30.

17 Claims, 24 Drawing Sheets

(1)

(2)

(1)

(2)

METHOD OF INSTALLING FURNACE WALLS OF A BOILER

BACKGROUND

The present invention relates to a method of installing furnace walls of a boiler, more specifically a method of installing a furnace wall of a boiler suitable for constructing a large-scale boiler such as one for a thermal power plan.

FIG. 24 shows the exemplary side view of the schematic diagram of coal fired large-scale boiler for a thermal power plant. A boiler 1 chiefly consists of a central portion 3 with a boiler furnace wall 2 and a convection pass wall 7, a front portion 5 with a coal bunker 4, and a rear portion 6 enclosing an air pre-heating device (not shown). The boiler furnace wall 2 and the convection pass wall 7 and others are suspended to a large beam 8 that is located on the top of a boiler frame, so as to release the thermal expansion during the burning operation.

Accordingly, in a general construction process for the construction of the boiler furnace wall 2 and the convection pass wall 7, the large beam 8 is attached on top of the established boiler frame that is as high as 60 to 100 meters. After that, by hanging various parts for constructing the boiler furnace wall 2 and the convection pass wall 7 from the large beam 8, those walls are assembled from the upper portion toward lower portion in sequence. However, this construction process does not have high operating efficiency because of the dangerous operation in high altitude. Especially, as the boiler furnace wall 2 has a shape with large length in the lengthwise direction, with the process of constructing from upper portion toward lower portion, the necessary period for the installation work becomes long since the lower portion can not be assembled until the upper portion is assembled. Therefore, the largest factor to prolong the entire construction period for the boiler facility was the installation work for the boiler furnace wall 2.

In order to alleviate the problem, Japanese patent laid-open publication H5-240405 discloses a boiler furnace wall installation method dividing the boiler furnace wall 2 into three portions of an upper portion of boiler proper, left and right lower portions of boiler proper, suspending the upper portion of boiler proper to the desired position after assembling each portion at the bottom position inside of the boiler frame, then connecting the left and right lower portions of boiler proper by translating them to the upper portion of boiler proper. With this method, the construction period is expected to be shortened since there is less operation in high altitude and the upper portion of boiler proper and the lower portions of boiler proper can be assembled in parallel.

However, the method disclosed requires a large space in the boiler frame premise for assembling the upper and lower portions of boiler proper since the operation takes place at the bottom position inside of the boiler frame, which introduces large restriction to the establishment of the boiler frame. Additionally, as the upper and lower portions of boiler proper are assembled in suspension in the same way as the conventional method, a dedicated temporary suspension mechanism for each portion of boiler proper is required.

SUMMARY

The objective of the invention is to provide method of installing a boiler furnace walls that can drastically reduce the installation period for the boiler furnace walls, without causing special restriction when establishing the boiler frame, and without the dedicated temporary suspension mechanism.

In order to achieve the objective, the installation method of the boiler furnace wall according to the present invention is a boiler furnace wall installation method with the upper portion of boiler proper and the lower portion of boiler proper, that assembles the upper portion of boiler proper while it is suspended from the top girder module deployed in the boiler frame. At the same time, four faces of furnace water wall panels that constitute the lower portions of boiler proper are pre-assembled on the ground. Upon the completion of each face of the furnace water wall panels, this unit is brought in to the boiler frame premise and lifted toward the upper portion of boiler proper, and upper ends of each face of the furnace water wall panels are connected to lower ends of the upper portion of boiler proper.

With the installation method of a boiler furnace wall according to the present invention, the furnace water wall panel with four faces that constitute the lower portion of boiler proper can be pre-assembled at the more convenient location with safe and efficient operation. In addition to that, the installation period for the boiler furnace wall can be shortened drastically due to the reasons that there is no special restriction to the establishment of the boiler frame, there is no need to make a dedicated temporary suspension mechanism, and the upper and lower portions of boiler proper can be assembled in parallel.

DETAILED DESCRIPTION OF EMBODIMENTS

Figure 1:
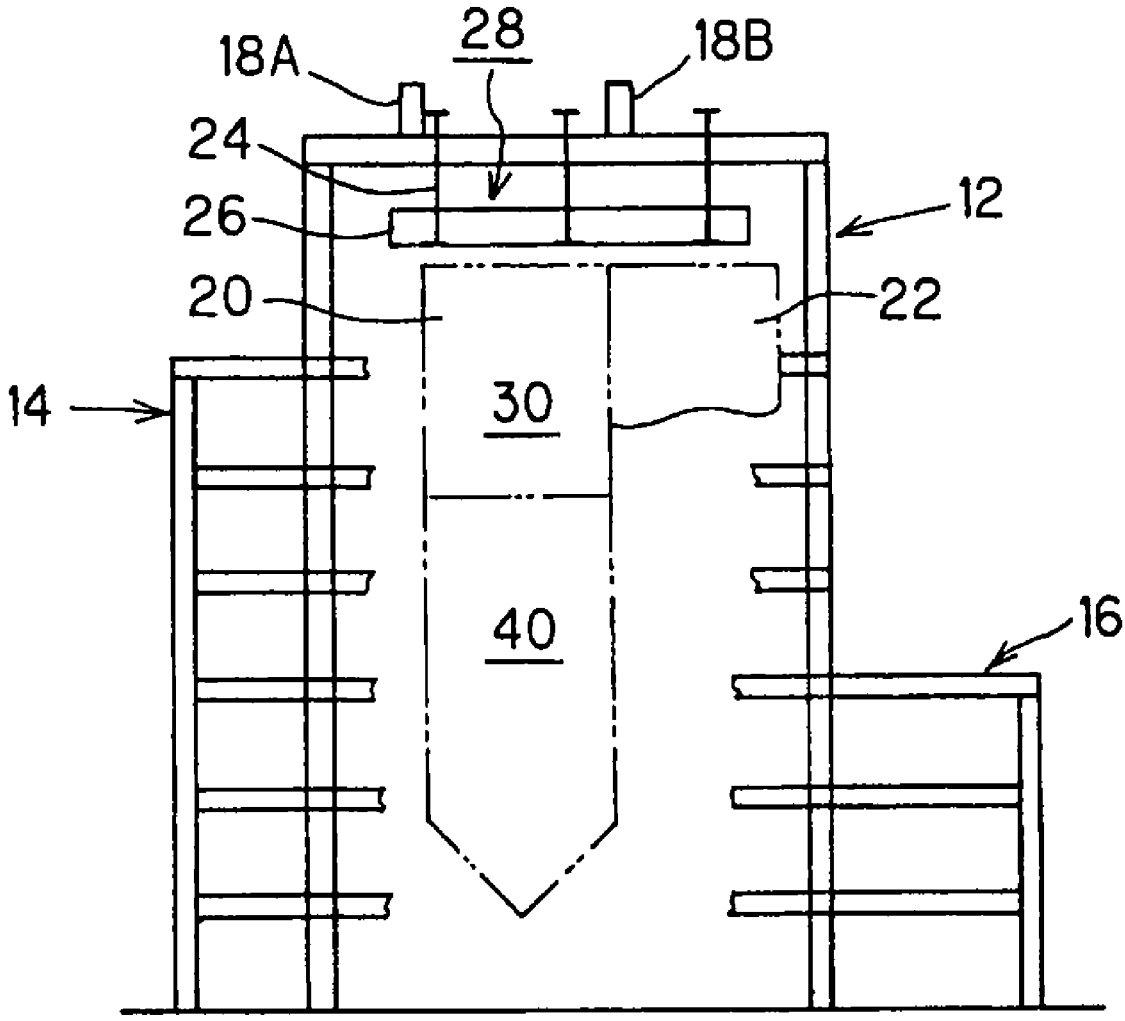
FIG. 1 is a side view for indicating the initial stage of the method of installing boiler furnace walls according to the present invention.
Figure 2:
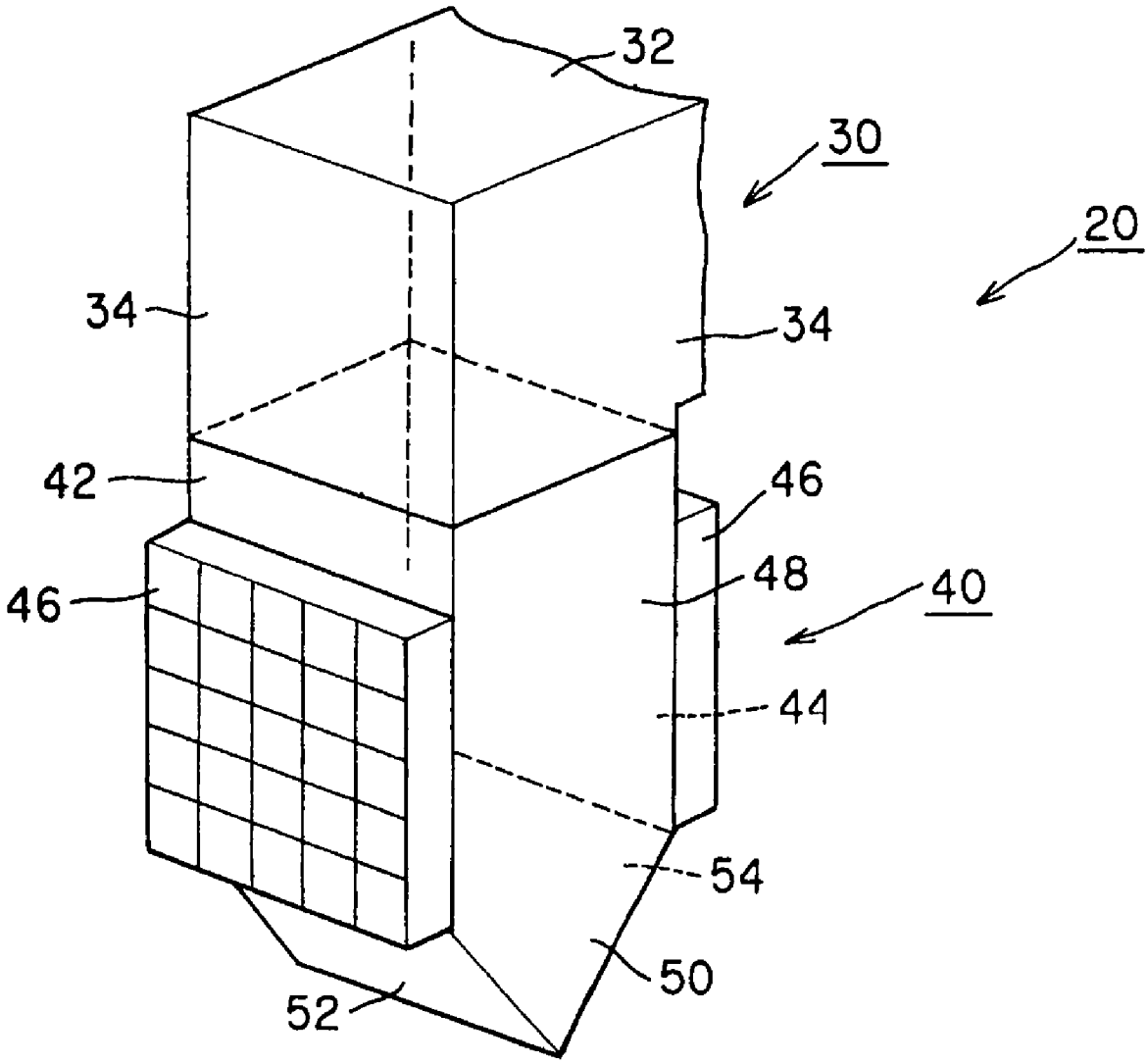
FIG. 2 is a perspective view of the main construction of the boiler furnace wall.

The method of installing the boiler furnace walls according to the present invention is a boiler furnace wall installation method with the upper portion of boiler proper and the lower portion of boiler proper that assembles the upper portion of boiler proper while it is suspended from the top girder module deployed in the boiler frame. At the same time, four faces of furnace water wall panels that constitute lower portions of boiler proper are pre-assembled on the ground. Upon the completion of each face of the furnace water wall panels, this unit is brought in to the boiler frame premise and lifted toward the upper portion of boiler proper, and upper ends of each face of the furnace water wall panels are connected to lower ends of the upper portion of boiler proper. And the furnace water wall panel with four faces that constitute the lower portion of boiler proper can be pre-assembled at the more convenient location with safe and efficient operation. In addition to that, the installation period for the boiler furnace wall can be shortened drastically due to the reasons that there is no special restriction to the establishment of the boiler frame, there is no need to make a dedicated temporary suspension mechanism, and the upper and lower portions of boiler proper can be assembled in parallel.

It should be born in mind other variation of the present invention is achieved by following sequence: After temporarily suspending two sides (left and right) of furnace water wall panels that are the parts of the lower portion of boiler proper, the upper portion of boiler proper is assembled while it is suspended from a top girder module located on the top of a boiler frame, after that, a furnace rear wall and a furnace front wall that are the parts of the lower portion of boiler proper are suspended while the temporarily suspended left and right furnace water wall panel are shifted to the designated position, and the upper ends of the furnace water walls forming four faces are connected to the lower ends of the upper portion of boiler proper. By doing this way, the left and right furnace water wall panels are temporarily suspended in advance, the left and right furnace water wall panels are shifted to the designated position when the connection with the upper portion of boiler proper becomes possible, and each face of the upper end of the furnace water wall panels is connected with each lower end of the upper portion of boiler proper. Therefore the unwanted interference is avoided even in case that the upper portion of boiler proper is assembled in advance and the upper portion of boiler proper itself usually becomes the obstacle when lifting the two (left and right) furnace water wall panels.

It is also desirable to assemble the accompanying buckstay and wind box together as one body, when each of the furnace water wall panels are pre-assembled. By doing this way, the buckstay and the wind box are assembled in the location with a good workability on the ground safely and efficiently. Additionally, the deflection and stress caused to the furnace water wall panels in the process of lifting them will be minimized because the attached buckstay and the wind box increase the rigidity of the furnace water wall panels significantly.

Furthermore, the present invention is characterized in that lifting jacks are located on the top of the boiler frame, and each of the furnace water wall panels are pulled up while the upper portions of furnace water wall panels are pulled by the lifting jacks and the lower portions are dragged on the ground. In this case, it is desirable to pull up the pendant coil to be placed immediately above the furnace rear wall with the lifting jacks mentioned above at the same time. When each of the pre-assembled furnace water wall panels is lifted, the lifting jacks located on the top of the boiler frame can be utilized. Therefore, the safety and efficient operation is achieved for pulling and lifting the huge (several hundred tons) furnace water wall panel blocks to be positioned in their designated position easily.

When the furnace rear wall is lifted, the pendant coil to be located immediately above the furnace rear wall is pulled up with the lifting jacks. Therefore, the installation operation of the pendant coil is achieved efficiently at the same time.

Figure 24:
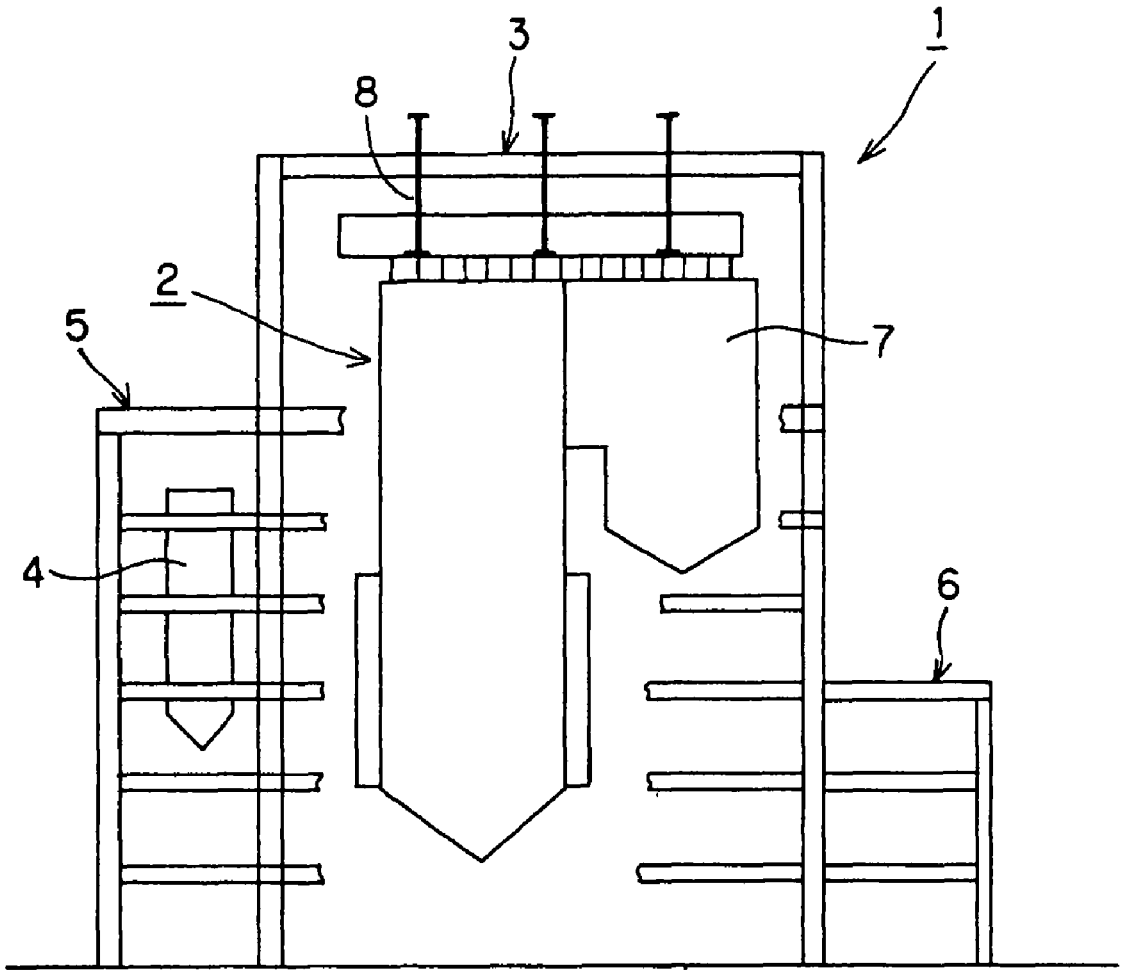
FIG. 24 shows the exemplary side view of the schematic diagram of coal fired large-scale boiler for a thermal power plant.

The embodiment relating to the method of installing boiler furnace walls according to the present invention will be explained together with the drawings attached. FIG. 1 shows the side view of the initial stage of the installation. Same as the above-mentioned FIG. 24, the boiler frame consists of a center portion 12, a front portion 14 and a rear portion 16. Multiple of lifting jacks 18A and 18B for installation are located on the top portion of the central portion 12 an advance. There are multiple of top girder 24 and multiple of top middle girder 26 that are located in between the top girder 24. A top girder module 28 consisting of the top girder 24 and the top middle girder 26 formed in a grid structure creates so-called hanging structure; boiler furnace walls 20 and convection pass walls 22 are lifted by multiple of suspension parts (not shown) suspended from the top girder module 28. The total weight of the large module reaches to several hundred tons. In case of such a huge top girder module 28, the operation efficiency will be reduced if a mobile crane on the top portion is used for the assembly since it requires many steps of operation in the high altitude. Therefore it is desirable to assemble the top girder module 28 on the ground, and to lift the entire assembled top girder module 28 with the multiple of lifting jacks 18A and 18B to be installed on the top portion of the central portion 12.

The boiler furnace walls 20 surrounded by a chain double-dashed line in FIG. 1 are sectioned by an upper portion of boiler proper 30 and a lower portion of boiler proper 40. The upper portion of boiler proper 30 is configured with a roof wall 32, side wall portions 34 and other internal components (not shown); and one side of the four side wall portions 34 is connected to one side of a convection pass wall 22. The lower portion of boiler proper 40 is configured with four faces of furnace water wall panels; and a furnace front wall 42 positioned toward the front portion 14 and a furnace rear wall 44 positioned toward the rear portion 16 are equipped with wind boxes 46 for attaching multiple of burners for burning. A hopper portion 50 is attached to the lower portions of left and right furnace water wall panels 48 located in faces in between the furnace front wall 42 and the furnace rear wall 44; and furnace hopper front walls 52 and 54 are connected the lower portion of the furnace front wall 42 and furnace rear wall 44 so as to link the opposite sides of the hopper portion 50.

For your information, each of furnace water wall panels such as the roof wall 32, the side wall portions 34 and the lower portion of boiler proper 40 is formed with rectangular water wall panels that have 2-3 meters of side width by welding connection. The boiler furnace wall 20 is configured by connecting the lower end of the side wall portions 34 of the upper portion of boiler proper 30 and the upper end of each furnace water wall panels of the lower portion of boiler proper 40.

Figure 3:
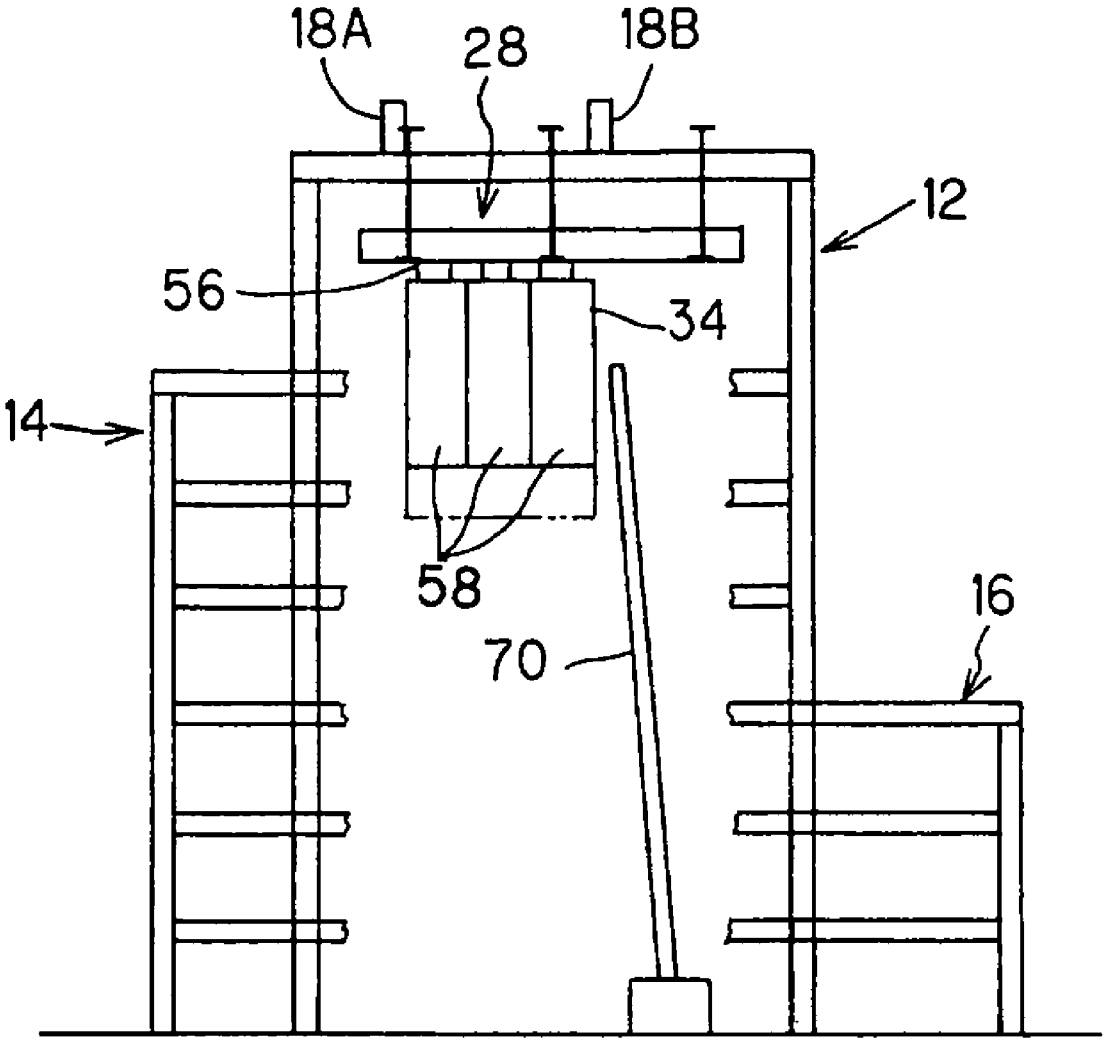
FIG. 3 is a side view showing the assemble operation of the upper portion of boiler proper.

In this preferred embodiment, the upper portion of boiler proper 30 in the boiler furnace wall 20 is assembled while it is suspended from the top girder module 28. In other words, after lifting the roof wall 32 with the multiple of suspension parts 56 suspended from the top girder module 28, the side wall portions 34 and internal components (not shown) are assembled sequentially while they are suspended. FIG. 3 illustrates that the side wall portion 34 is partially assembled by welding the water wall panel 58. The lower part of the side wall portion 34 illustrated with the chain double-dashed line is assembled sequentially. The lifting operations to supply necessary parts are mainly conducted by a mobile crane 70 on the ground.

Figure 4:
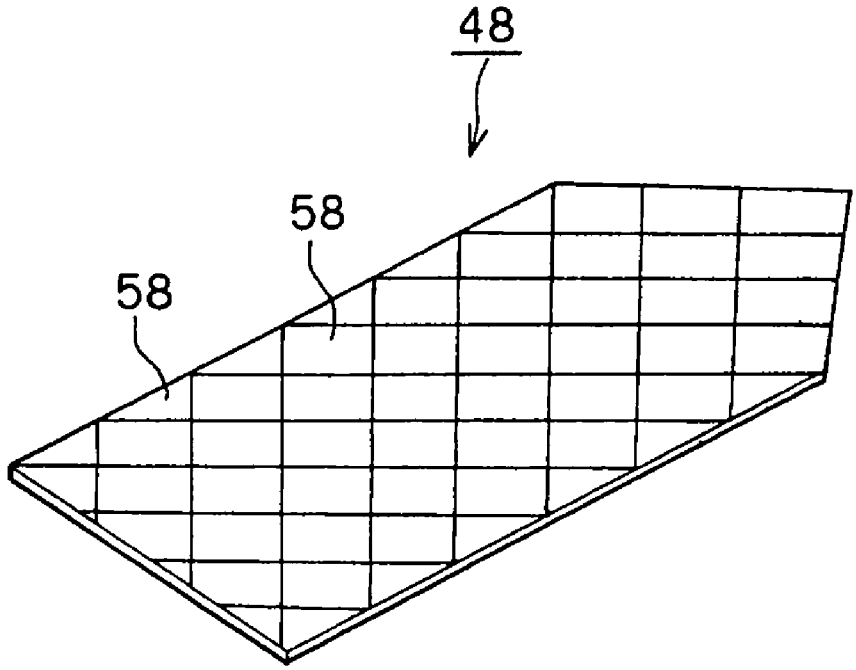
FIG. 4 shows perspective views of the furnace water wall panel 48 during the assembling stage.
Figure 4:
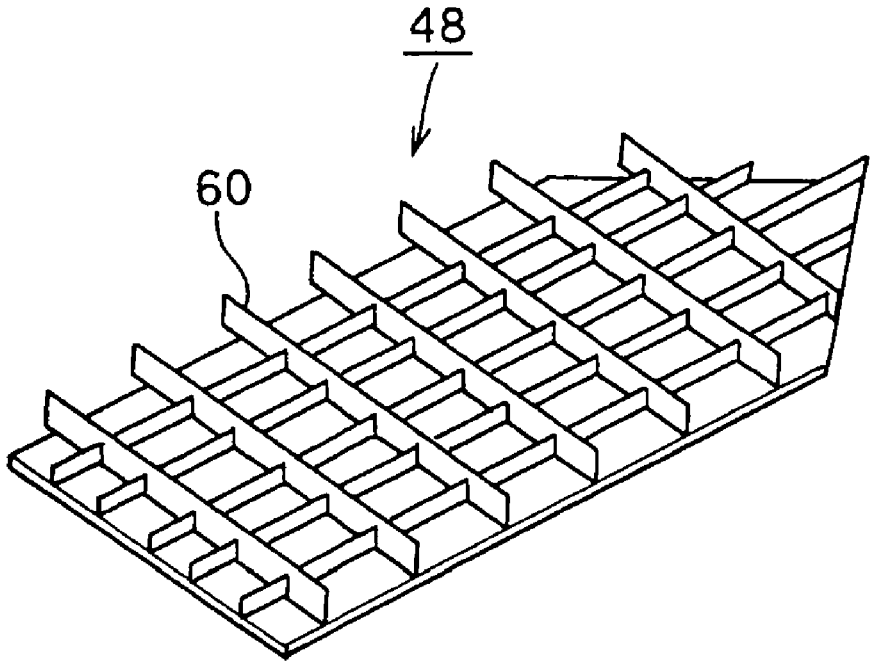

At the same time, each of four face furnace water wall panels are pre-assembled on the ground respectively for forming the lower portion of boiler proper 40. FIG. 4 (1) indicates the first process: Multiple water wall panels 58 are aligned on a level block and welded together. FIG. 4 (2) indicates the second process: buckstays 60 are attached to the face of connected furnace water wall panel for forming a grid support. The assembly steps of the furnace water wall panel 48 can be switched; namely, the buckstays 60 can be assembled together first and then they can be attached on the top of the furnace water wall panel.

Figure 5:
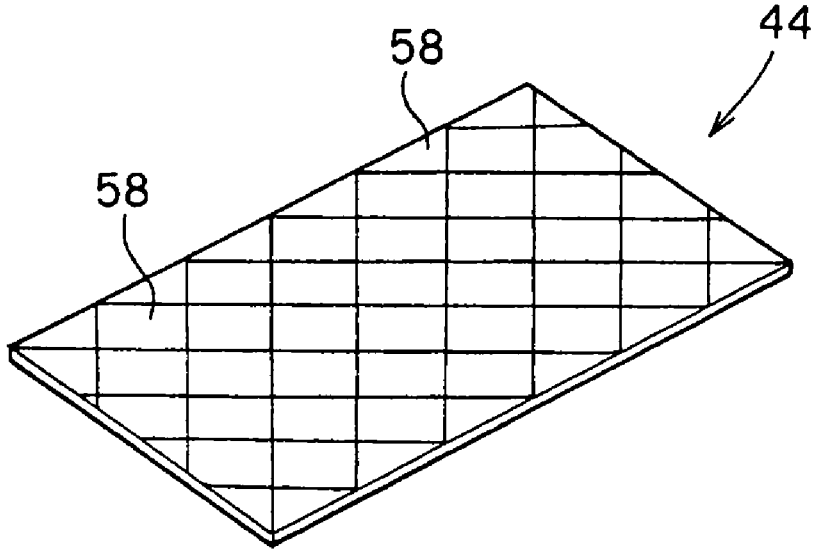
FIG. 5 shows the furnace rear wall 44 during the assembling stage.
Figure 5:
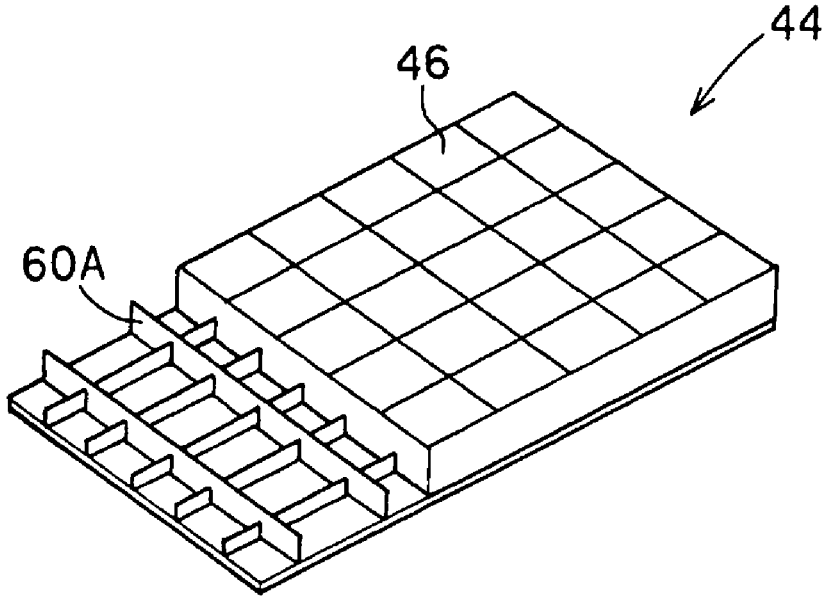
Figure 6:
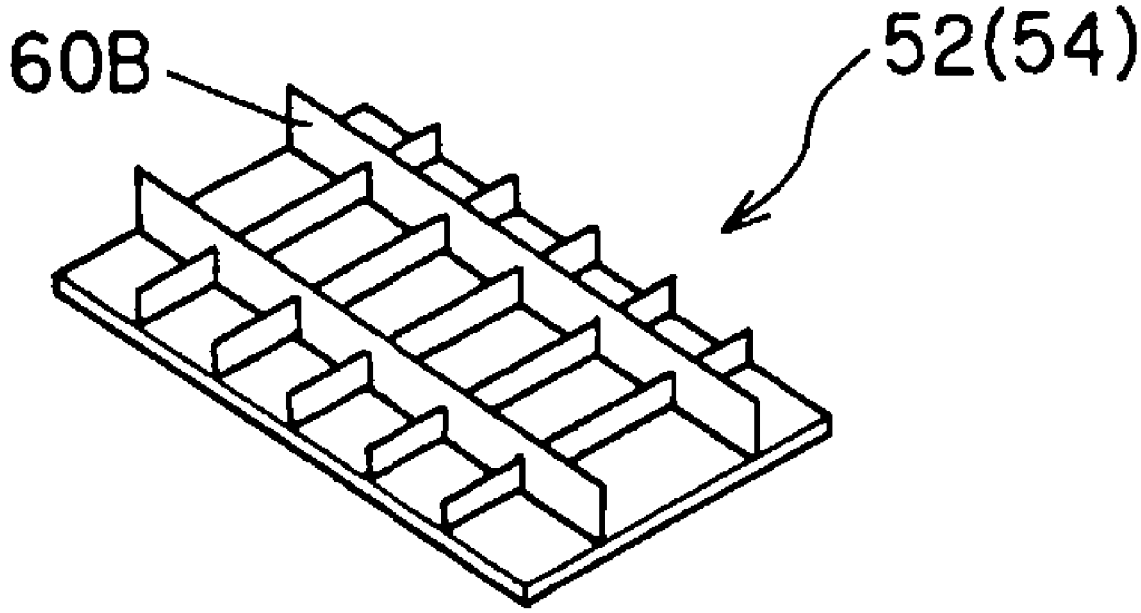
FIG. 6 shows a perspective view of the furnace hopper front wall 52, 54 during the assembling stage.

FIG. 5 shows the slanted perspective view of the assemble stage of the furnace rear wall 44. FIG. 5 (1) indicates the first process: Multiple of water wall panel 58 are aligned on a level block and welded together for forming the vertical face of the furnace rear wall 44. FIG. 5 (2) indicates the second process: the wind boxes 46 are attached to the face of connected furnace water wall panel for forming a grid support. The buckstays 60 are attached to the other face of connected furnace water wall panel that does not have the wind boxes 46 for forming a grid support. The assembly steps of the furnace front wall 42 can be switched; namely, the wind box 46 and buckstays 60A can be assembled together first and then the furnace water wall panel can be connected on the top of these wind box 46 and buckstays 60A.

As for furnace hopper front and rear walls 52 and 54 to be connected to the furnace front wall 42 and furnace rear wall 44, the furnace water wall panel with buckstay 60B to be attached are formed as a one body part.

Figure 7:
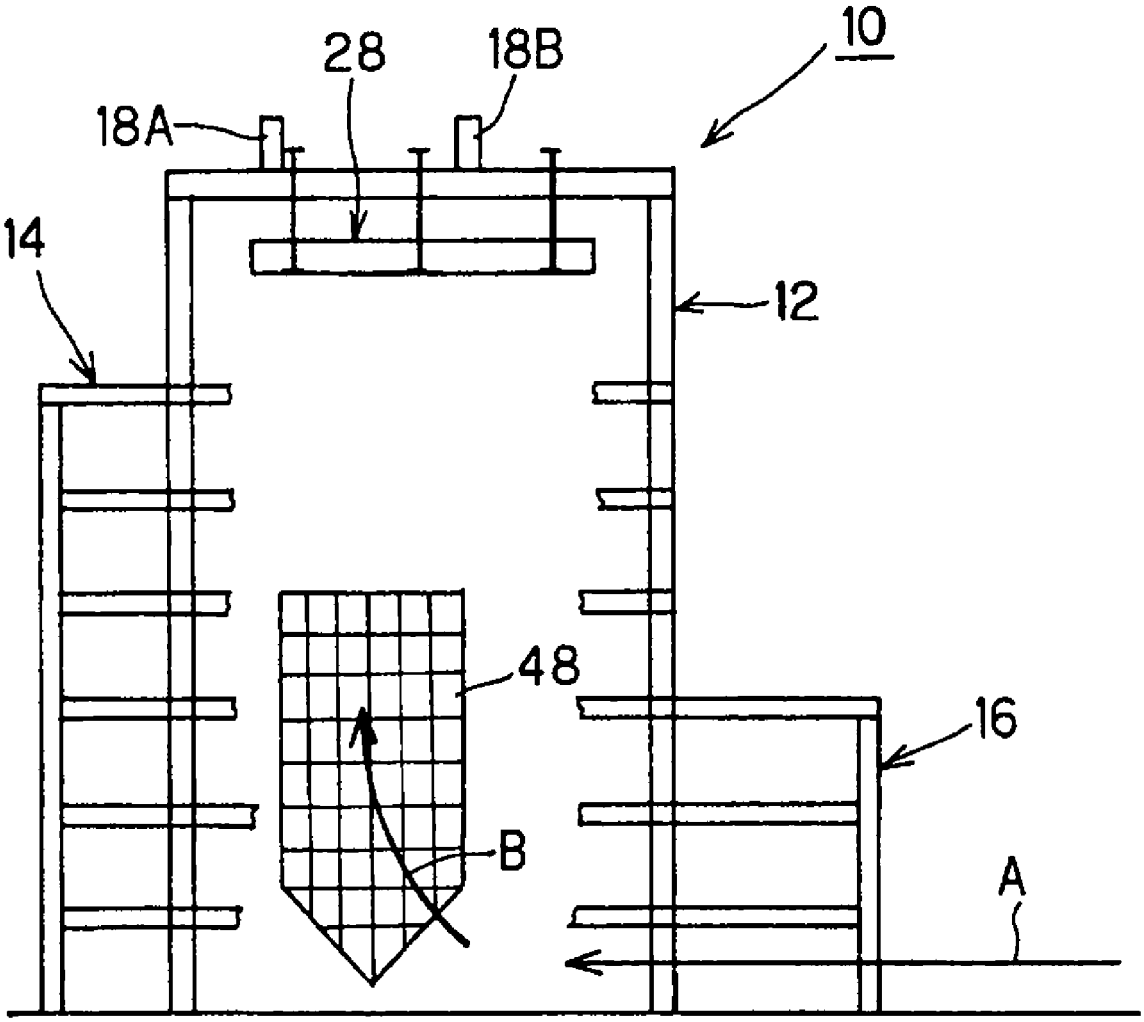
FIG. 7 is a side view of the first stage of one embodiment of the present invention.
Figure 8:
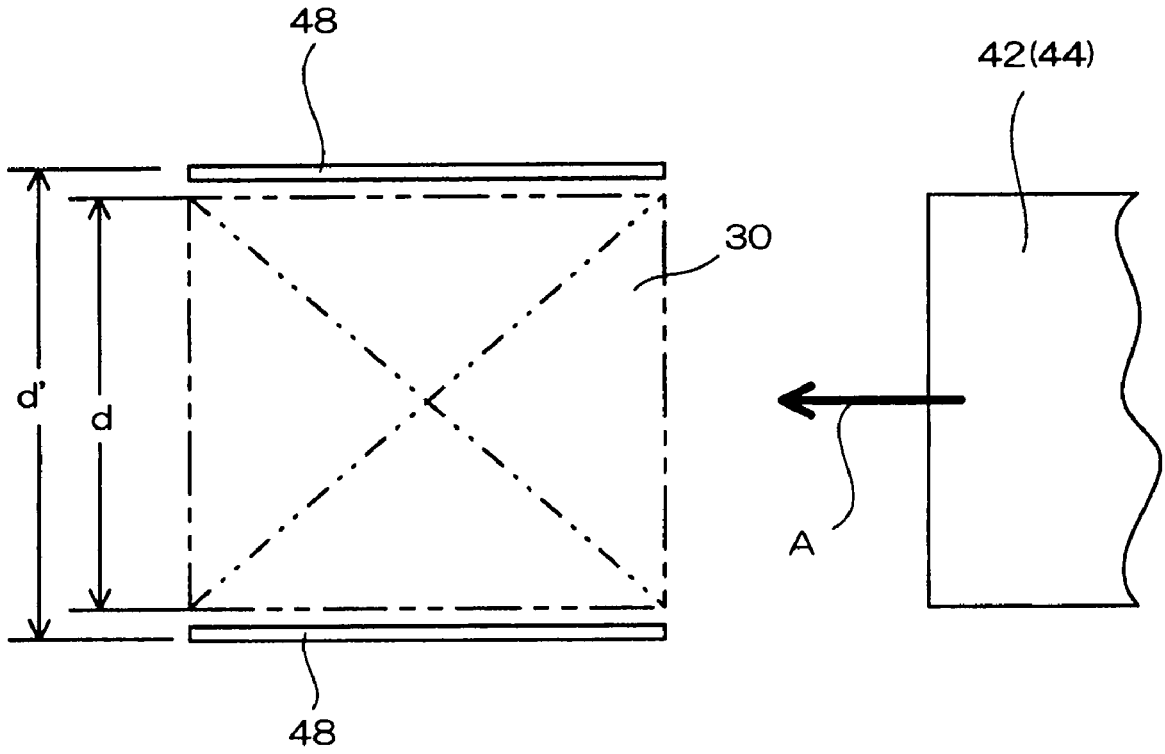
FIG. 8 is a plan view showing the two couples of left and right furnace water wall panel 48 while temporarily suspended.

FIG. 7 indicates the first stage of the installation process. At first, the furnace water wall panel 48 (one of a left and right pair of the furnace water wall panels 48) that is located in the viewer side relative to the paper surface is pulled horizontally then placed immediately below the center portion 12. Then by utilizing a winch (not shown), the furnace water wall panel 48 is pulled with twists in the route of arrow B so as to temporarily suspend and position the furnace water wall panel 48 vertically in the middle height. FIG. 8 shows plan view of the stage when the temporary suspension of both left and right furnace water wall panels 48 has been completed. As shown in the drawing, the gap d' between the left and right pair of the furnace water wall panels 48 temporarily suspended is larger than the final gap d relative to the upper portion of boiler proper 30, maintaining the open status. By utilizing this improved method, the assembly operation of the upper portion of boiler proper 30 and the pulling and lifting operation of the furnace water wall panel 44 and the furnace front wall 42 (to be explained later) become easier.

Figure 9:
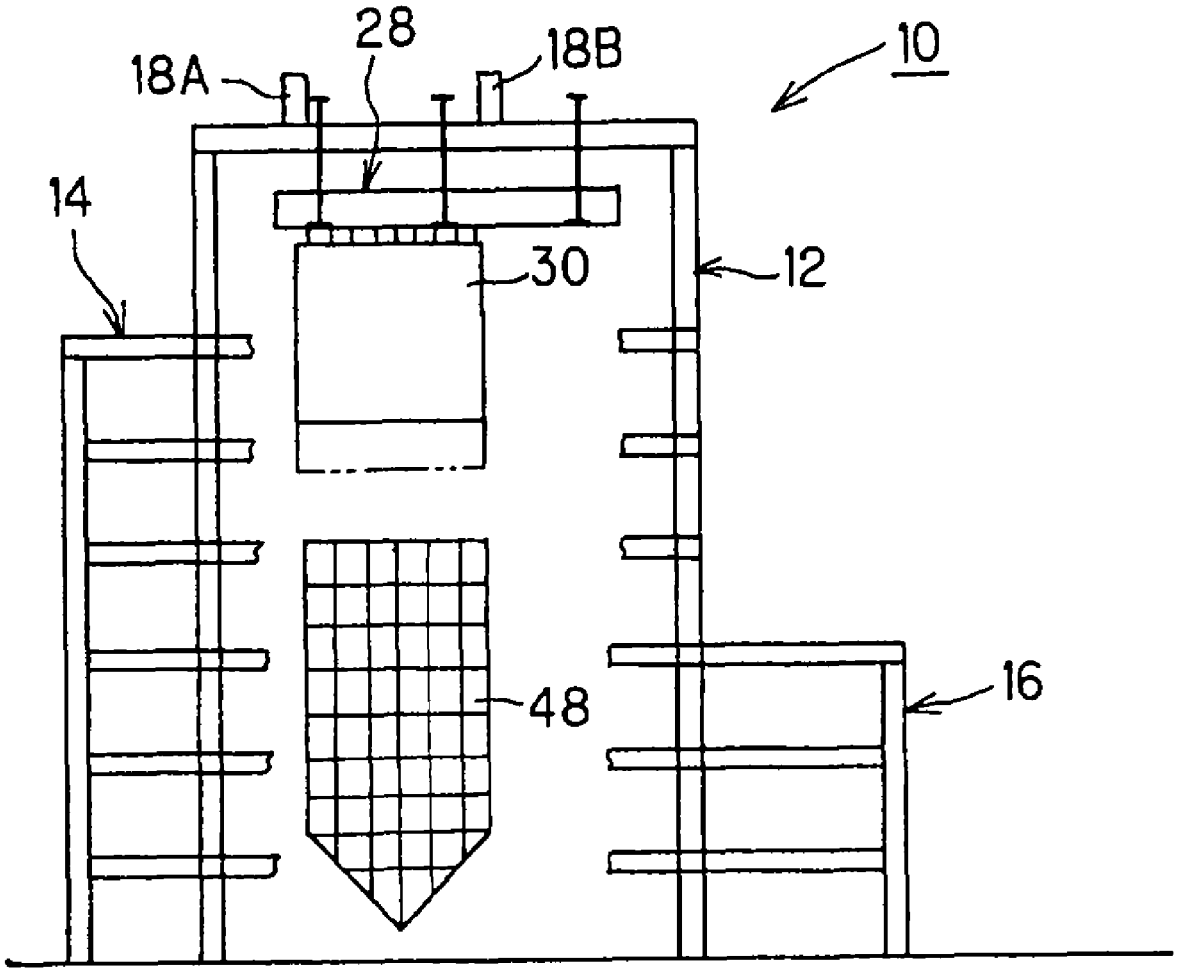
FIG. 9 is a side view of the second stage of one embodiment of the present invention.

FIG. 9 shows the second stage. In this second stage, the upper portion of boiler proper 30 is assembled on the top of the boiler frame.

Figure 10:
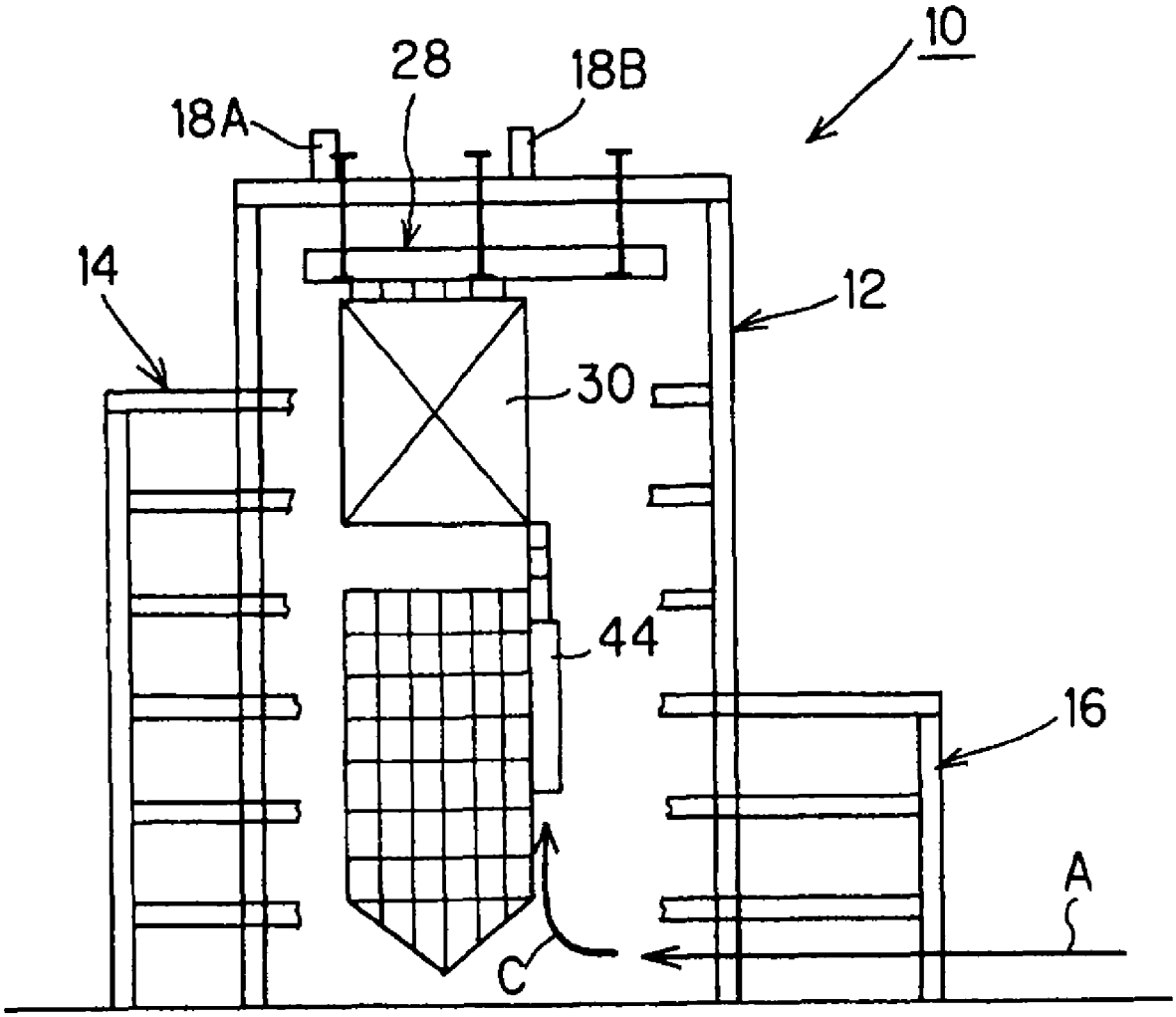
FIG. 10 is a side view of the third stage of one embodiment of the present invention.

FIG. 10 shows the third stage. In this third stage, upon the completion of the assembly of the upper portion of boiler proper 30 to certain stage, the furnace rear wall 44 is pulled and lifted, and the lower end of the upper portion of boiler proper 30 and the upper end of the furnace rear wall 44 are connected. At first, the furnace rear wall 44 is pulled in the direction shown by an arrow A horizontally so as to reach to the immediately below the upper portion of boiler proper 30. Then the upper portion of the furnace rear wall 44 is pulled up with a lifting jack 18B while the lower portion is dragging on the ground so as to be lifted as indicated with an arrow C. After that, the connection with the lower portion of boiler proper 30 is conducted at an appropriate timing.

Figure 11:
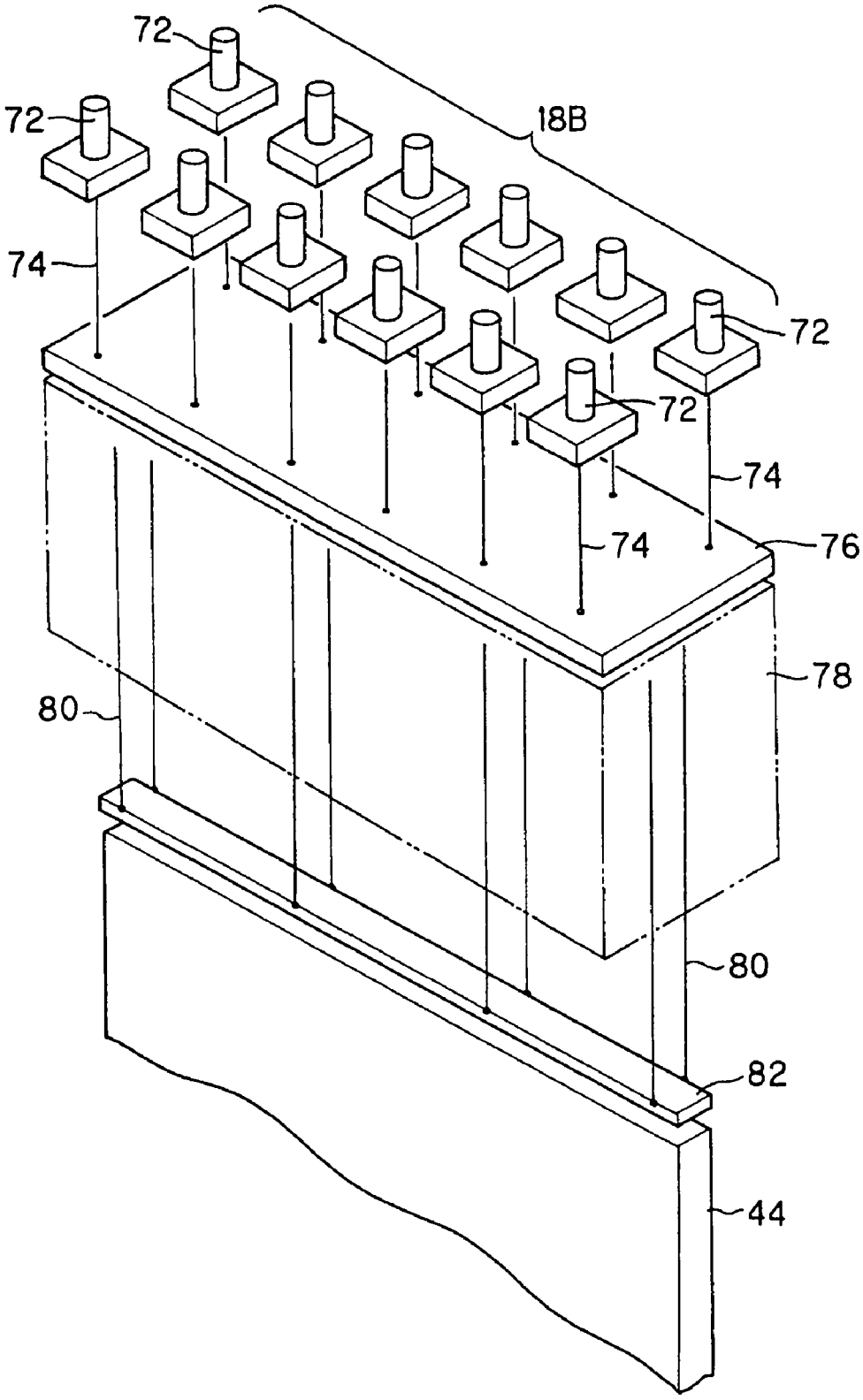
FIG. 11 is a partial detailed perspective view of the furnace rear wall 44 during the suspension.

FIG. 11 shows the perspective view illustrating the partial details during the time of lifting the furnace rear wall 44. In the top part of the center portion 12 of the boiler frame (See FIG. 1), there are 12 center-hole system lifting jacks 72, 72, . . . 72 are pre-installed as an installation lifting jack 18B. These center-hole system lifting jacks 72 are positioned immediately above the vicinity of the upper surface of the furnace rear wall 44 so as to pull up the post-furnace water wall panel 44 smoothly. The center-hole system lifting jack 72 is a lifting jack with a sling rod 74 made by connecting unit rods screwed together whose unit length is several tens of centimeters that is equivalent to one or several strokes; and the lifting jack move the sling rod 74 going through a center hole of the center-hole system lifting jack 72 up and down in a stroke by stoke fashion with a hydraulic pressure activation mechanism. Since it is easier to form a long sling rod 74 by selecting a number of connecting unit rod, it is preferable for configuring the high-lift lifting jack means. The unit lifting capability of a center-hole system lifting jack 72 is, for example, 200 tons. With 12 lifting jacks, overall lifting capability is 2,400 tons. As a center-hole system lifting jack 72 can be the rod system as explained or the strand system. It is also possible to employ a lifting jack other than the center-hole system.

In an ordinary large-scale boiler, a pendant coil 78 that is an internal component of the upper portion of boiler proper 30 is located immediately above the furnace rear wall 44. Therefore, in this embodiment, the construction method of more efficient installation operation is employed by pulling up the pendant coil 78 and the furnace rear wall 44 at the same time. In this method, the upper balance beam 76 is suspended by the sling rods 74 suspended from each center-hole system lifting jack 72. The pendant coil 78 is lifted together by a bolt connection device (not shown) connecting the coil to the upper hugging balance 76. From the upper balance beam 76, multiple of sling bolts 80 are hanging through the pendant coil 78 by selecting its gaps; and a lower balance beam 82 is attached to the end of the sling bolts 80. The furnace rear wall 44 is suspended from the lower balance beam 82 with a hinge device (not shown). By forming a lifting mechanism like this, the pendant coil 78 whose weight is approximately 1,000 tons and the furnace rear wall 44 whose weight is approximately 350 tons are lifted together then installed to the designated positions respectively.

Figure 12:
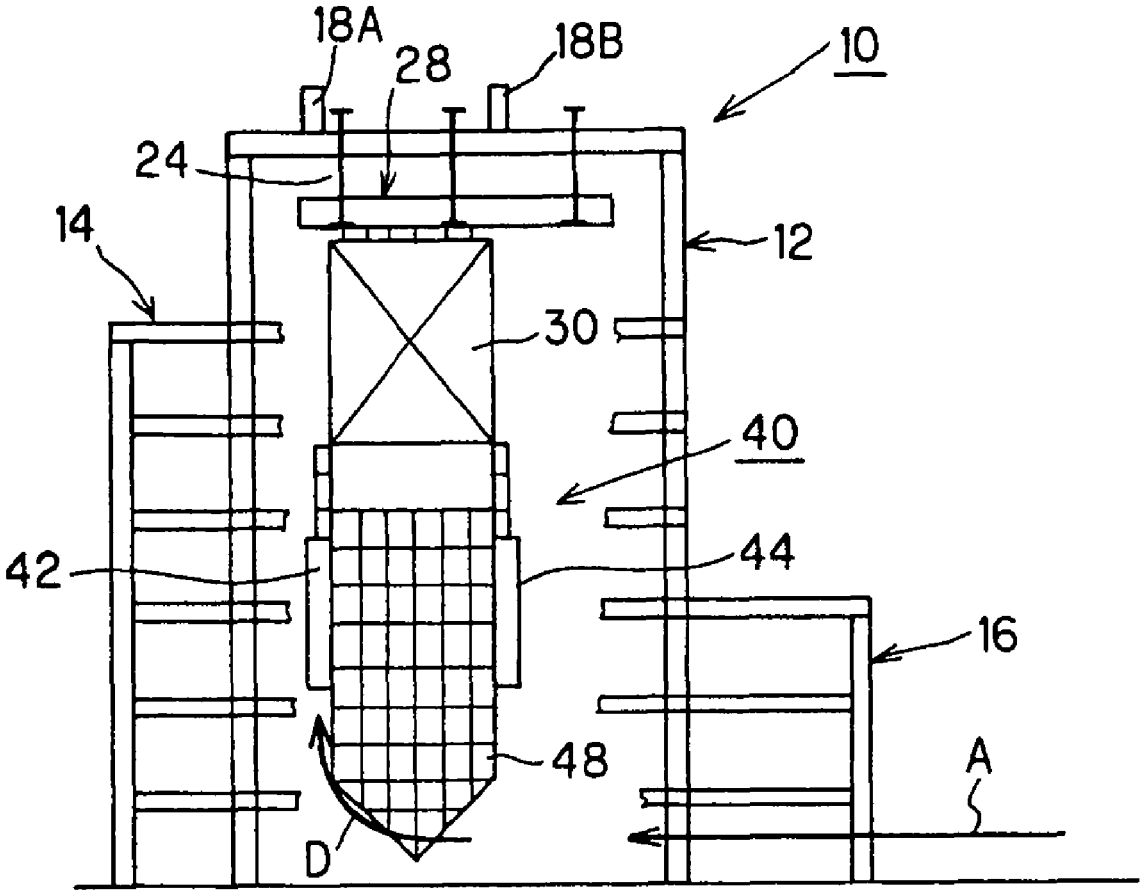
FIG. 12 is a side view of the fourth stage of one embodiment of the present invention.

FIG. 12. shows the fourth stage. In this fourth stage, the furnace front wall 42 is suspended and attached to the lower end of the upper portion of boiler proper 30 and the upper end of the furnace front wall 42. At first, the furnace front wall 42 is pulled in the direction shown by an arrow A horizontally so as to reach to the immediately below the upper portion of boiler proper 30. Then the upper portion of the furnace front wall 42 is pulled up with a lifting jack 18A while the lower portion is dragging on the ground so as to be lifted as indicated with an arrow D. After that, the connection with the lower portion of boiler proper 30 is conducted at an appropriate timing. In the case that the wind boxes 46 and the buckstays 60A are located in the upper side as shown in FIG. 5 (2), it is inconvenient when lifting the furnace front wall 42 in the arrow D direction since the orientation of furnace front wall 42 is opposite. Therefore, it is more convenient to assemble the furnace front wall 42 to make the wind boxes 46 and the buckstays 60A to be in the lower side, then pull it toward the immediate below the upper portion of boiler proper 30.

Figure 13:
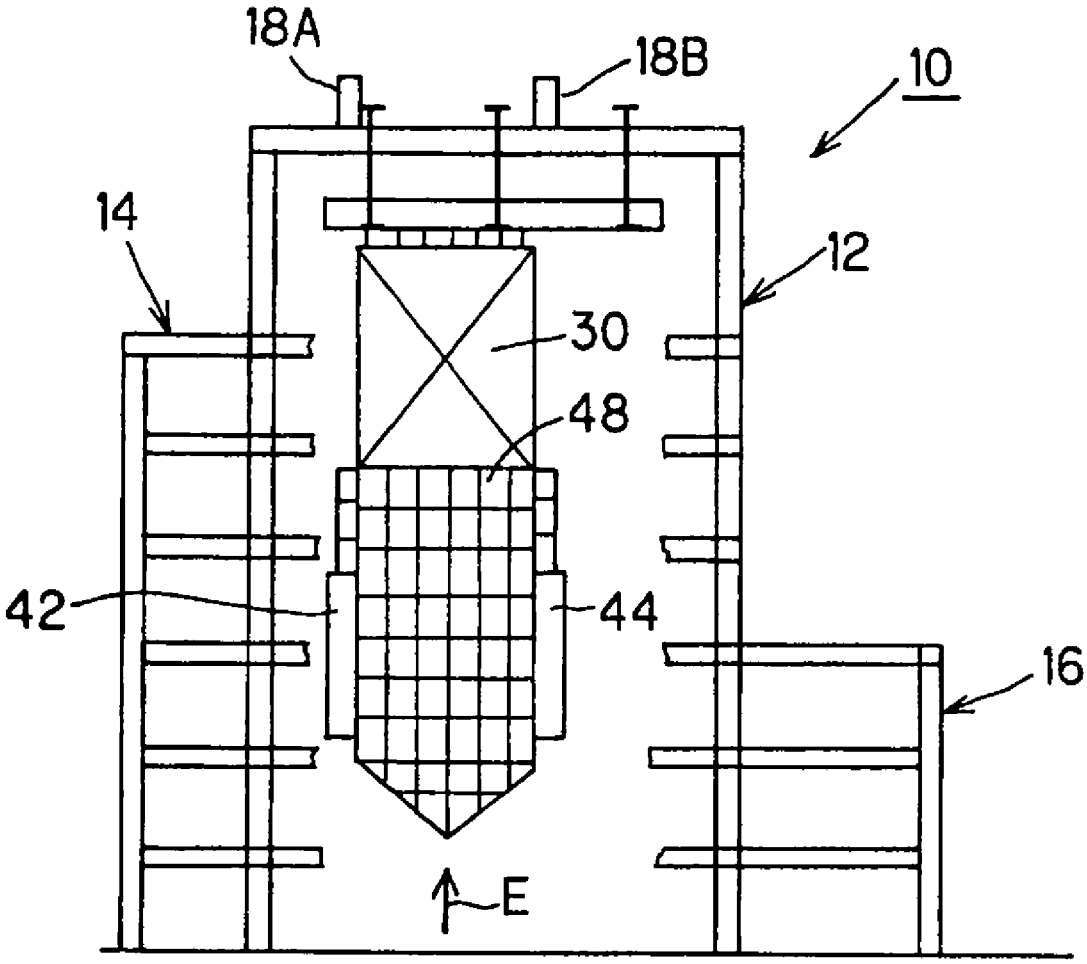
FIG. 13 is a side view of the fifth stage of one embodiment of the present invention.

FIG. 13 shows the fifth stage. In the fifth stage, the furnace water wall panels 48 hanging on in the medium height temporarily separated with a gap d' wider than the final gap d (shown in FIG. 8) is pulled up in the direction shown with an arrow E to be a designated position. After that, the connections with the lower end of the upper portion of boiler proper 30, adjacent furnace front wall 42 and furnace rear wall 44 will be conducted at appropriate timing respectively.

Figure 14:
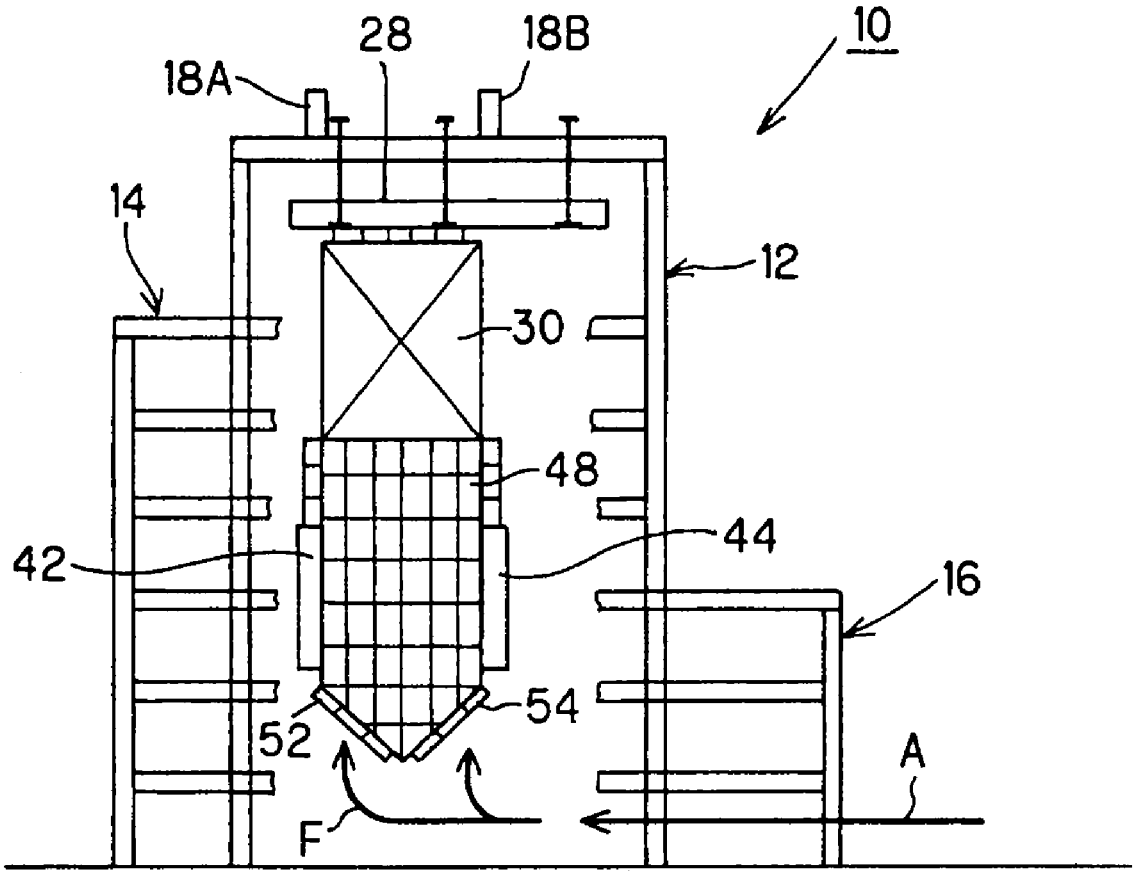
FIG. 14 is a side view of the sixth stage of one embodiment of the present invention.

FIG. 14 shows the sixth stage. In the sixth stage, the furnace hopper front and rear walls 52 and 54 are pulled in the direction shown by an arrow A horizontally so as to reach to the immediately below the left and right furnace water wall panels 48, furnace front wall 42 and furnace rear wall 44. Then the furnace hopper front and rear walls 52 and 54 are pulled up with a lifting device (not shown) in the way arrow C shows. After that, the connection with the lower end of the furnace water walls is conducted at an appropriate timing; the lower hopper portion located on the bottom of the boiler furnace walls 20 is completed.

Figure 15:
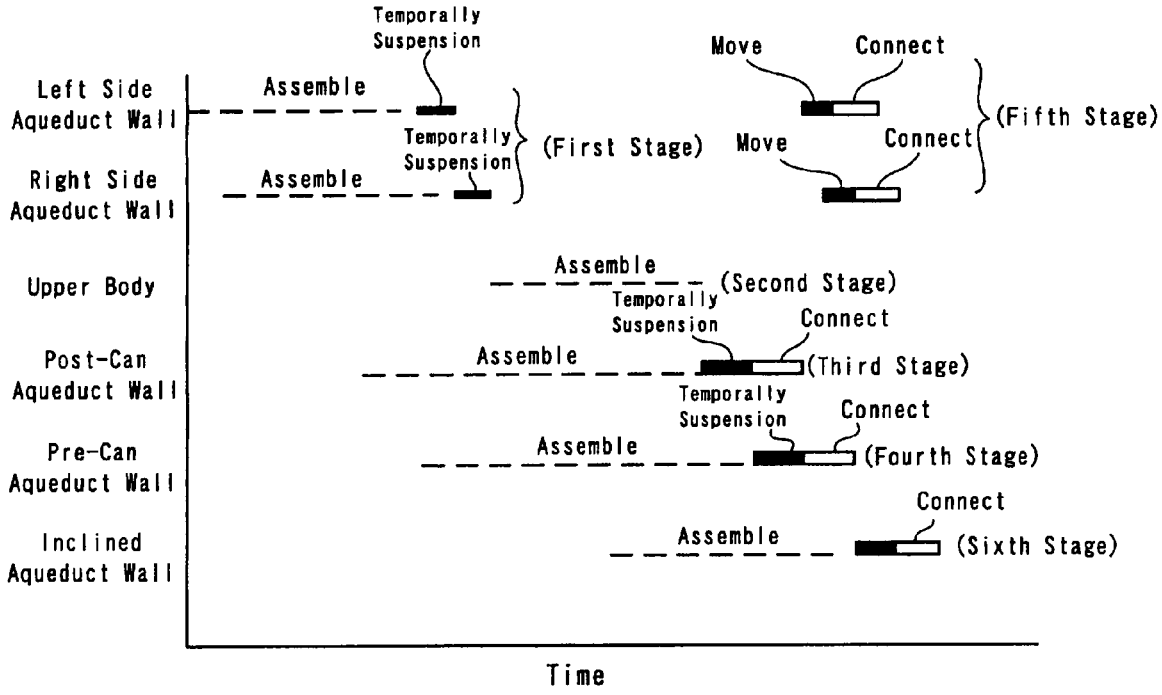
FIG. 15 is a process diagram showing the generalized stages of installation.

FIG. 15 is the process diagram showing the generalized steps of installation explained above. The first stage is the temporary suspension of the left and right faces of the furnace water wall panels 48, the second stage is the assembly of the upper portion of boiler proper 30 at the top portion of the boiler frame, the third stage is the suspension (including the suspension of the pendant coil simultaneously) and connection of the furnace rear walls 44 pre-assembled on the ground, the fourth stage is the suspension and connection of the furnace front wall 42 assembled on the ground, the fifth stage is the movement and connection of the left and right furnace water wall panels 48, and the sixth stage is the suspension and connection of the furnace hopper front and rear panels 52, 54 assembled on the ground.

Figure 16:
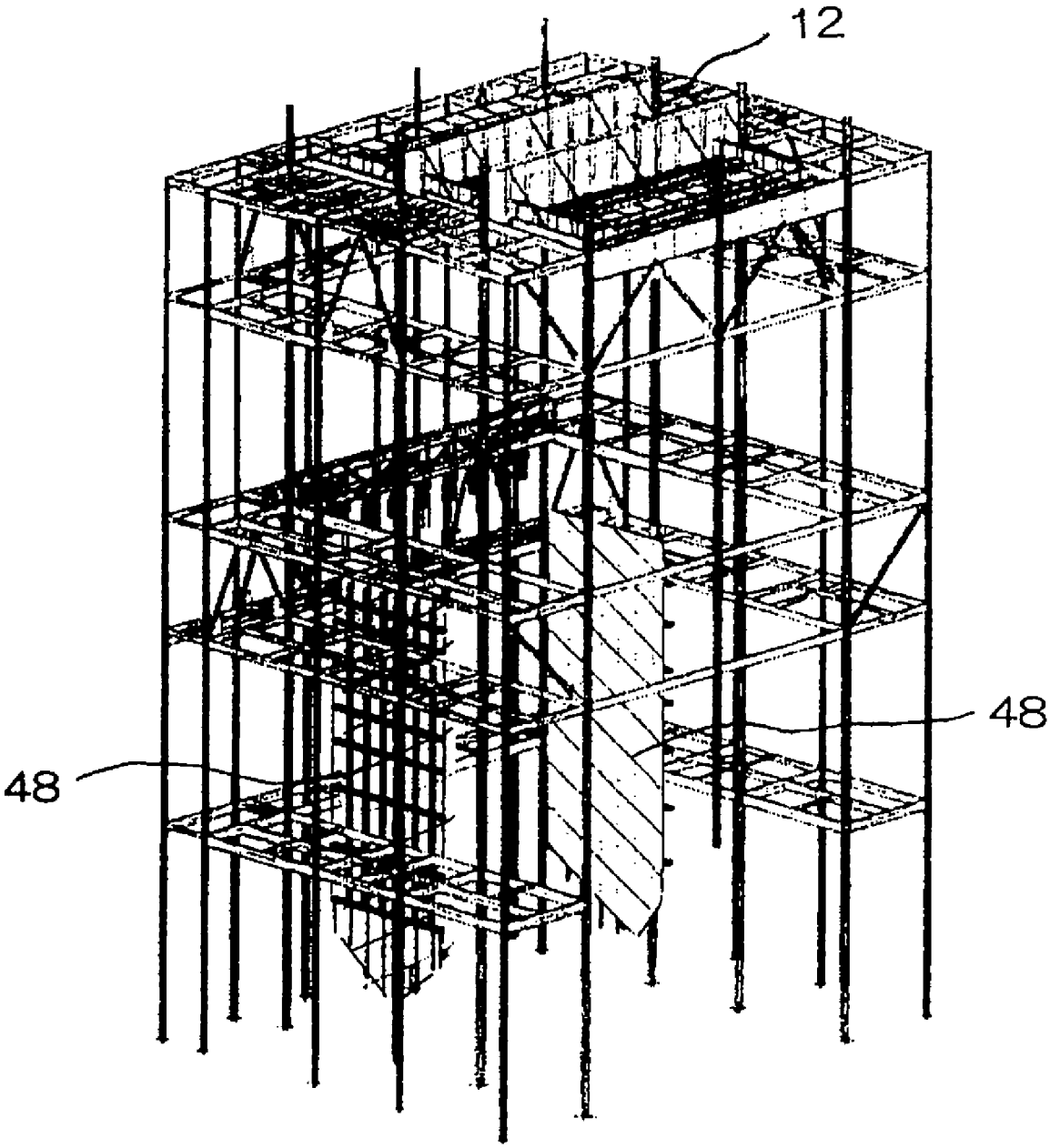
FIG. 16 is a perspective view of the first stage of one embodiment of the present invention.
Figure 17:
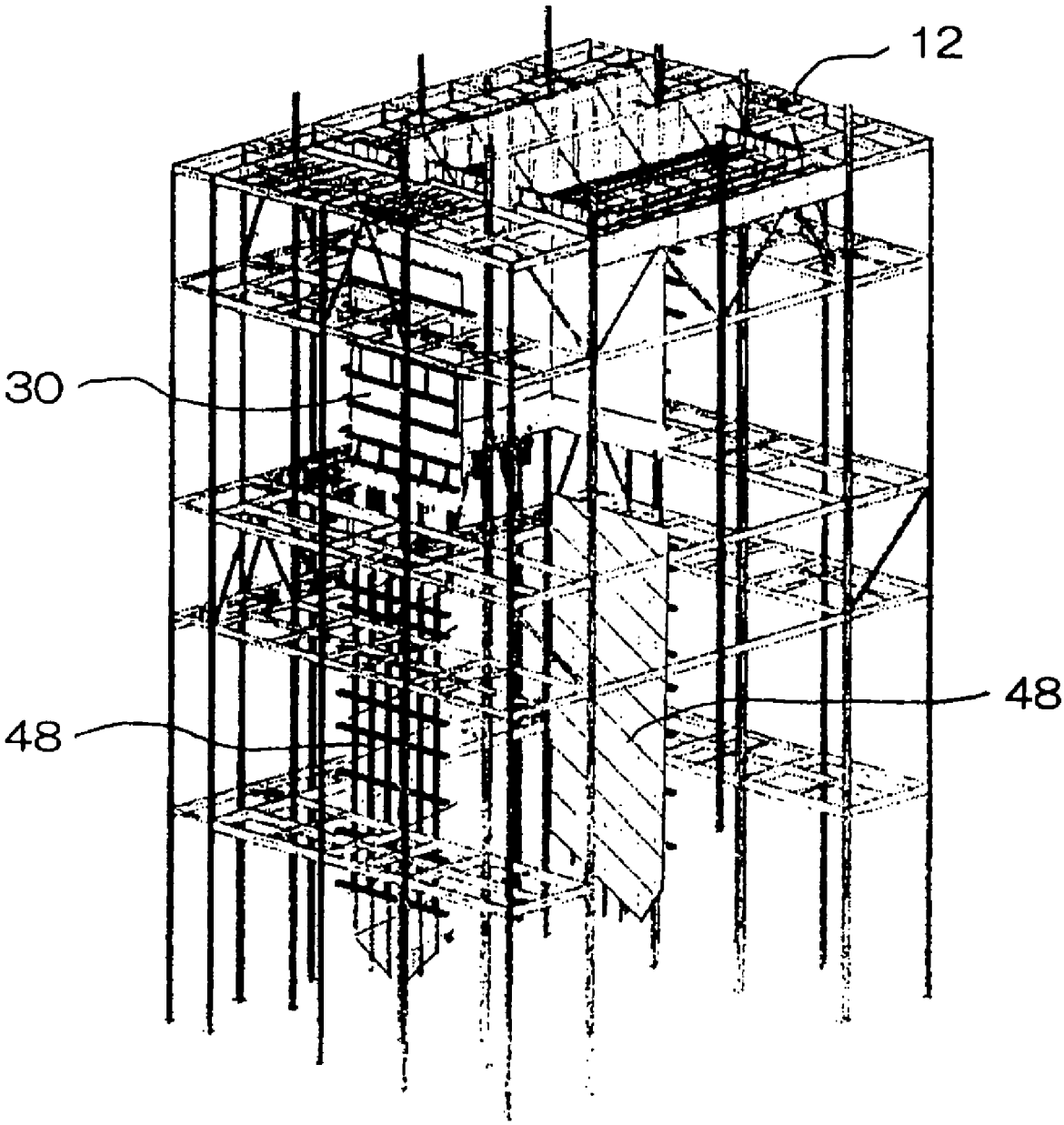
FIG. 17 is a perspective view of the second stage of one embodiment of the present invention.
Figure 18:
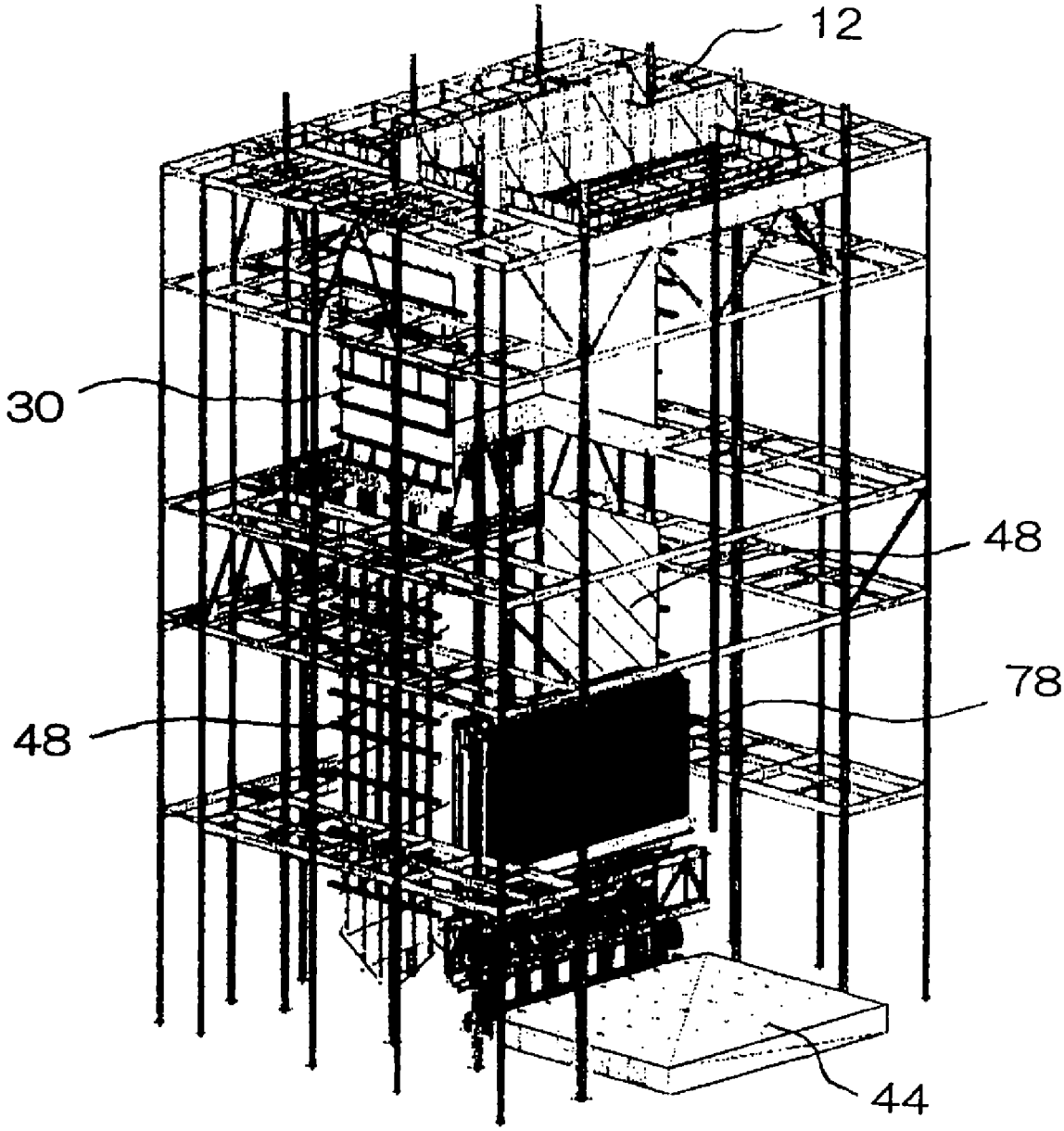
FIG. 18 is a perspective view of the initial phase of the third stage of one embodiment of the present invention.
Figure 19:
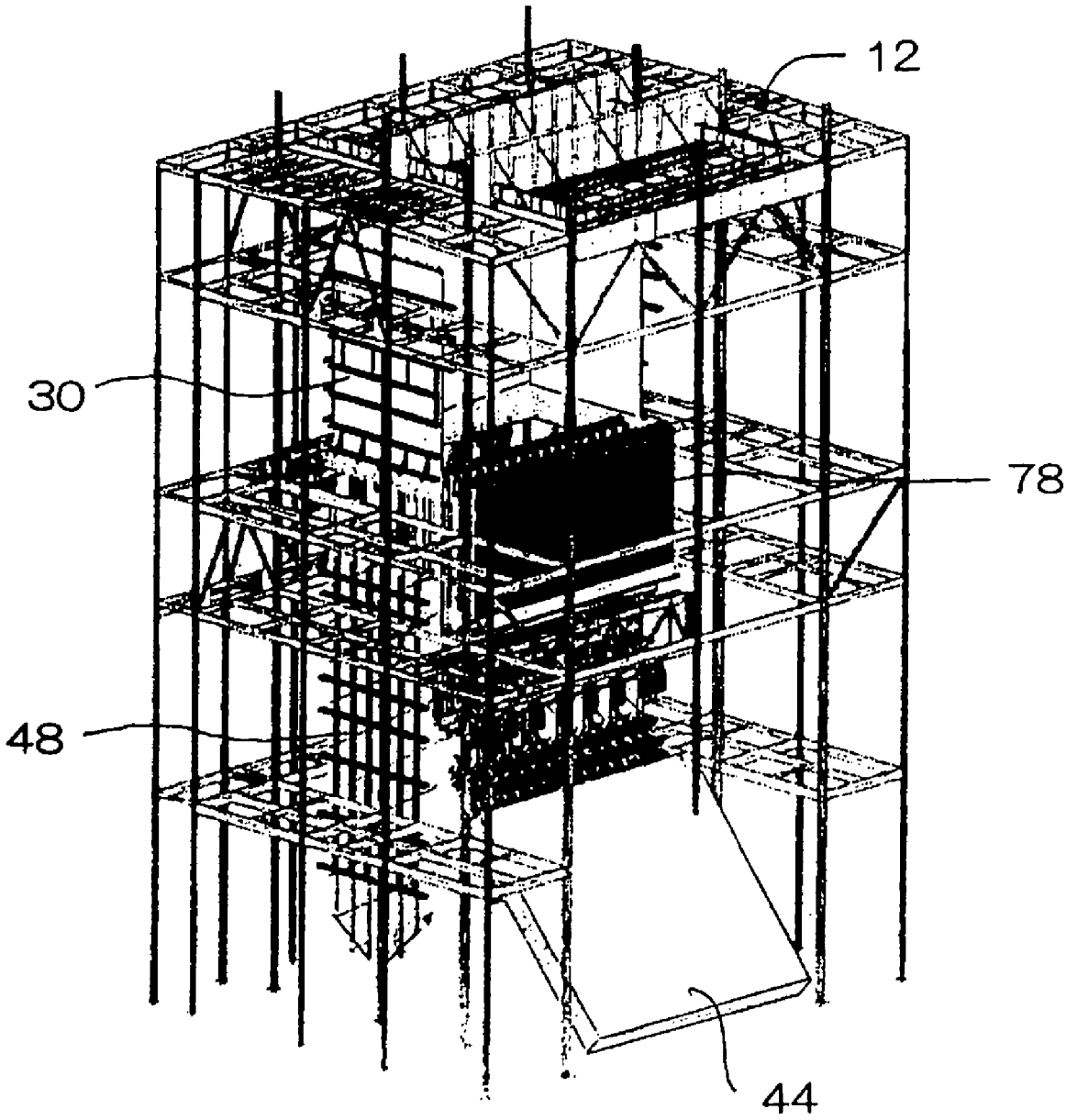
FIG. 19 is a perspective view of the middle phase of the third stage of one embodiment of the present invention.
Figure 20:
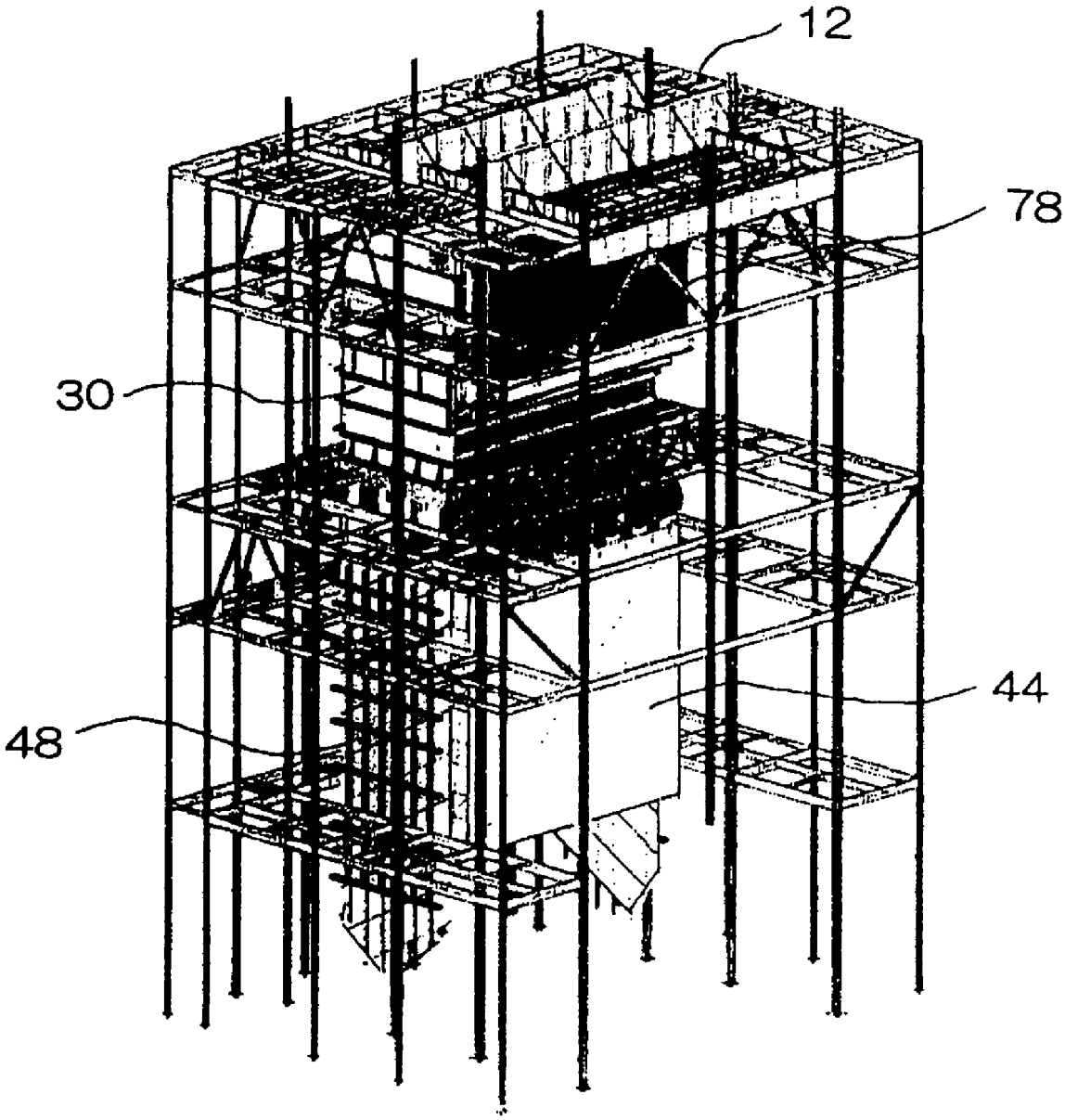
FIG. 20 is a perspective view of the final phase of the third stage of one embodiment of the present invention.
Figure 21:
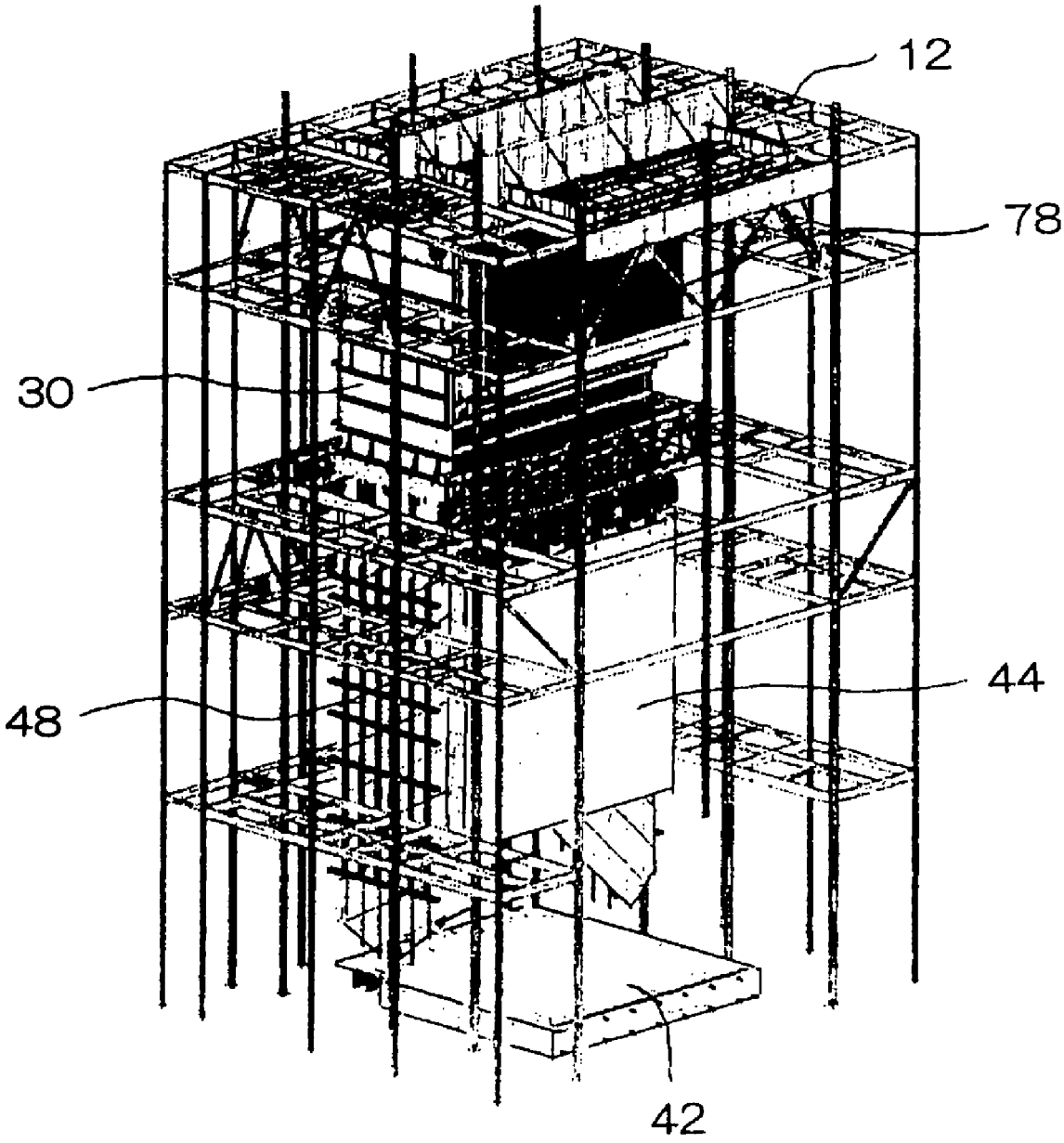
FIG. 21 is a perspective view of the initial phase of the fourth stage of one embodiment of the present invention.
Figure 22:
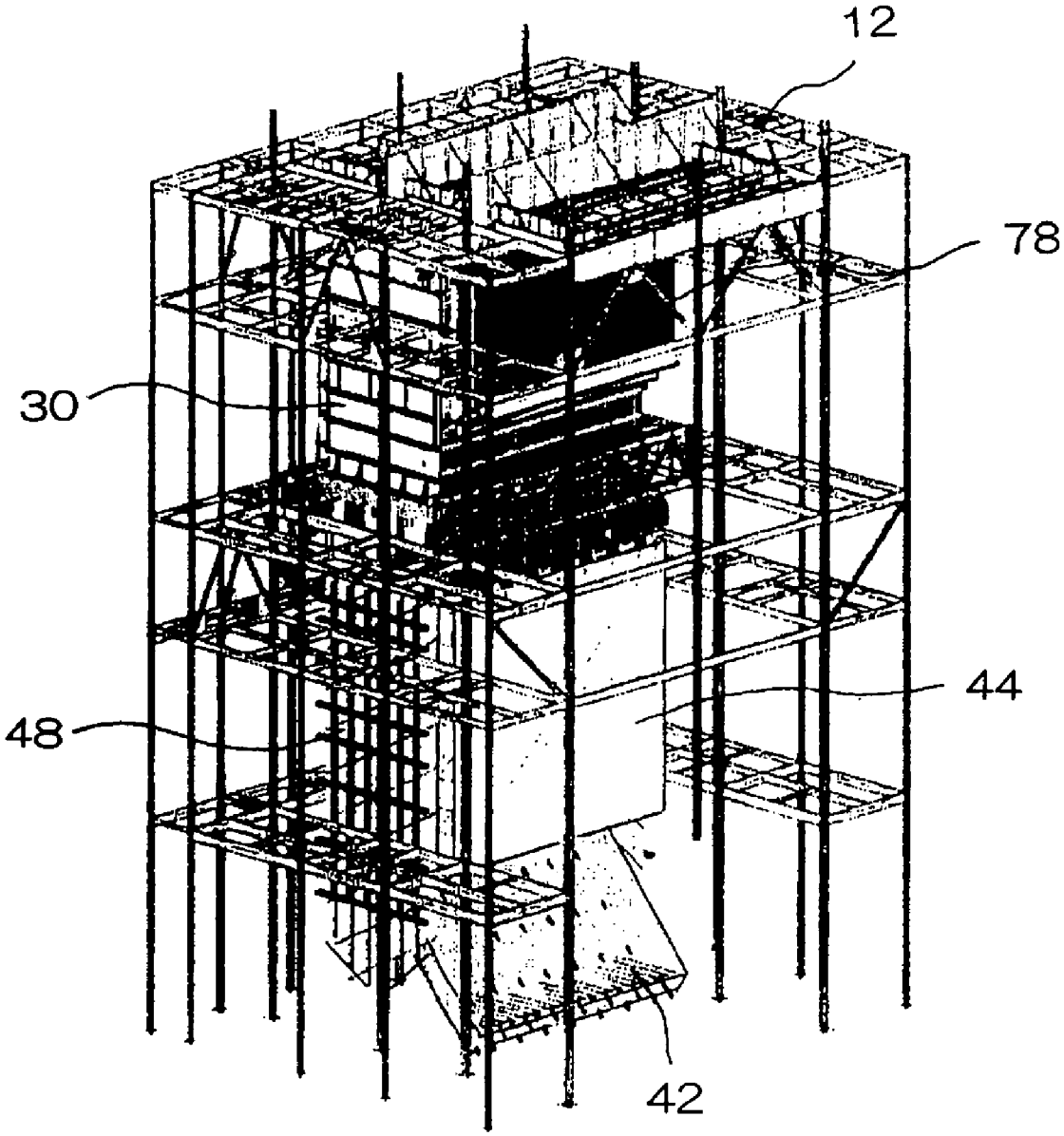
FIG. 22 is a perspective view of the middle phase of the fourth stage of one embodiment of the present invention.
Figure 23:
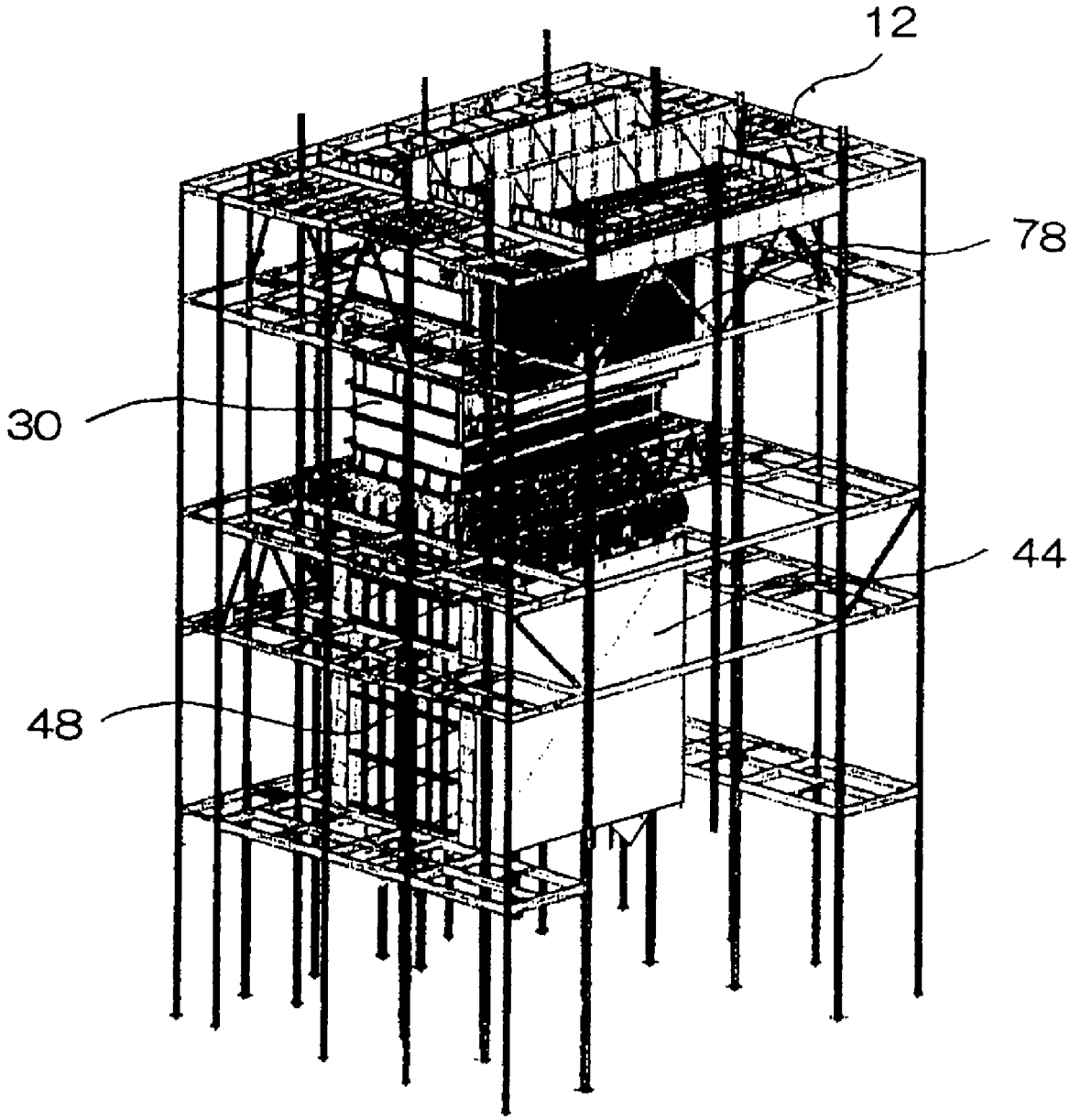
FIG. 23 is a perspective view of the final phase of the fourth stage of one embodiment of the present invention.

FIG. 16 through FIG. 23 is the prospective view of each stage of above-mentioned installation stages. FIG. 16 shows the first stage, FIG. 17 shows the second stage, FIG. 18 through FIG. 20 show the third stage, FIG. 21 through FIG. 22 show the fourth stage, and FIG. 23 shows the fifth stage.

As explained above, the boiler furnace wall installation method according to the embodiment, the upper portion of boiler proper 30 is assembled while suspended from the top girder module 28 located on the top of the center portion 12 of the boiler frame, while the four faces of furnace water wall panels 48, 48, 44 and 42 are pre-assembled on the ground and pulled up, and the upper end of each of the furnace water wall panel is connected with the lower end of the lower portion of boiler proper. Therefore, the assembly of each furnace water wall panels 48, 48, 44 and 42 are conducted on the high workability place on the ground safely and efficiently. Additionally, there is no special restriction while constructing the boiler frame; there is no need to utilize the dedicated temporary lifting mechanism; and drastically reduce the installation work time due to the simultaneous assembly of the upper portion of boiler proper 30, the furnace rear wall 44 and furnace front wall 42 and so on.

Among the furnace water wall panels, two faces of left and right furnace water wall panels 48 is suspended temporarily in advance, the two faces of left and right furnace water wall panels 48 are moved to the designated positions when the connection with the upper portion of boiler proper 30 become possible, and connection of upper end of each face of the furnace water wall panels with the lower end of the upper portion of boiler proper is conduced. Therefore, the unwanted interference is avoided even in case that the upper portion of boiler proper 30 is assembled in advance and the upper portion of boiler proper itself 30 usually becomes the obstacle when lifting the two (left and right) furnace water wall panels.

Additionally, in assembling the furnace water wall panels 48, 48, 44 and 42, the buckstays 60 and 60 A together with the wind boxes 46 are assembled together, so the attachment of the buckstays 60 and the wind boxes 46 can be done at the high workability location on the ground safely and efficiently. It should also be noted that the buckstay 60 and 60A or the wind boxes 46 significantly increase the rigidity of the furnace water wall panels; therefore the deflections and stresses caused in the furnace water wall panels 48, 48, 44 and 42 by lifting the pre-assembled furnace water walls are minimized.

Furthermore, the lifting jacks 18A and 18B equipped on the top of the boiler frame are utilized for lifting the pre-assembled furnace front walls 42 and furnace rear wall 44, the gigantic furnace water wall panel blocks weigh several hundred tons can be pulled up to the desired location easily, which the safety of operation and the efficiency are obtained.

Moreover, since the pendant coil 78 to be positioned immediately above the furnace rear wall is pulled up together with the furnace rear wall 44 with the 12 center hole system lifting jack 72 at the same time, the efficient installation operation of the pendant coil 78 is achieved.

The above preferred embodiment is explained as an installation method including the steps of suspending a pair of left and right furnace water wall panels 48 temporarily in advance, assembling the upper portion of boiler proper 30 while suspended from the top girder module located on the top of the boiler frame, suspending the furnace rear wall 44 and furnace front wall 42 one by one, moving the temporarily suspended left and right furnace water wall panels 48 to the designated position, and connecting the upper end of the each face of the furnace water wall panel and the lower end of the upper portion of boiler proper. However, the present invention is not limited to the installation method disclosed in the embodiment. For example, it includes the method of assembling the upper portion of boiler proper 30 in advance, then lifting the four faces of the furnace water wall panels pre-assembled on the ground, and connecting the upper end of each face of the furnace water wall panel and the lower end of the upper portion of boiler proper.

While the invention herein disclosed has been described by means of specific embodiments and applications thereof, numerous modifications and variations could be made thereto by those skilled in the art without departing from the scope of the invention set forth in the claims.

What is claimed is:

1. A method of installing boiler furnace walls with an upper portion of a boiler proper and a lower portion of the boiler proper comprising:

assembling the upper portion of the boiler proper while it is suspended from a top girder module placed on a top of a boiler frame;

pre-assembling each of four face furnace water wall panels individually for forming the lower portion of the boiler proper respectively on the ground;

lifting each of said four face furnace water wall panels individually after the completion of the pre-assembling; and connecting an upper portion of each face of said four face furnace water wall panels with a lower portion of the upper portion of the boiler proper while the upper portion of the boiler proper is suspended within the boiler frame, wherein a lifting jack is located on the top of said boiler frame, the lifting jack simultaneously hanging the upper portions of the furnace water wall panels and dragging the lower portions on the ground and lifting the lower portions into position.

2. The method of claim 1 wherein left and right face furnace water wall panels within said four face furnace water wall panels are temporarily suspended in advance, the upper portion of the boiler proper is assembled while it is suspended from said top girder module beam module placed on the top of said boiler frame, a furnace front wall and a furnace rear wall of the lower portion of boiler proper are suspended sequentially, said left and right face furnace water wall panels temporarily suspended are moved to designated positions, and the upper portion of each face of said furnace water wall panels and the lower portion of the upper portion of the boiler proper is connected.

3. The method of claim 1 wherein buckstays and a wind box to be attached to the furnace water wall panels are assembled together when each of said furnace water wall panels are formed.

4. The method of claim 1 wherein a pendant coil to be positioned immediately above a furnace rear wall among said furnace water wall panels is pulled up together with said furnace rear wall with said lifting jack at the same time.

5. A method of installing boiler furnace walls with an upper portion of a boiler proper and a lower portion of the boiler proper, comprising:

assembling the upper portion of the boiler proper while it is suspended from a top girder module placed on a top of a boiler frame;

pre-assembling each of four face furnace water wall panels individually for forming the lower portion of the boiler proper respectively on the ground;

lifting two opposite face furnace water wall panels after the completion of the pre-assembling and suspending them temporarily in position;

lifting two other opposite face furnace water wall panels after the completion of the pre-assembling;

moving all four face furnace water wall panels to the designated positions; and connecting an upper portion of each face of said furnace water wall panels with a lower portion of the upper portion of the boiler proper that is formed by said four face furnace water wall panels being connected while the upper portion of the boiler proper is suspended within the boiler frame, wherein a lifting jack is located on the top of said boiler frame, the lifting jack simultaneously hanging the upper portions of the furnace water wall panels and dragging the lower portions on the ground and lifting the lower portions into position.

6. The method of claim 5 wherein left and right face furnace water wall panels within said four face furnace water wall panels are temporarily suspended in advance, the upper portion of the boiler proper is assembled while it is suspended from said top girder module beam module placed on top of said boiler frame, a furnace front wall and a furnace rear wall of the lower portion of boiler proper are suspended sequentially, said left and right face furnace water wall panels temporarily suspended are moved to designated positions, and the upper portion of each face of said furnace water wall panels and the lower portion of the upper portion of the boiler proper is connected.

7. The method of claim 5 wherein buckstays and a wind box to be attached to the furnace water wall panels are assembled together when each of said furnace water wall panels are formed.

8. The method of claim 5 wherein a pendant coil to be positioned immediately above a furnace rear wall among said furnace water wall panels is pulled up together with said furnace rear wall with said lifting jack at the same time.

9. The method of claim 5 wherein said lower portion of the boiler proper comprises a pair of left and right furnace water wall panels, furnace front wall, furnace rear wall and furnace hopper walls.

10. A method of installing boiler furnace walls with an upper portion of a boiler proper and a lower portion of the boiler proper comprising:

assembling the upper portion of the boiler proper while it is suspended from a top girder module placed on a top of a boiler frame;

pre-assembling each of four face furnace water wall panels individually for forming the lower portion of the boiler proper respectively on the ground beneath the boiler frame;

attaching buckstays and a wind box to a couple of said four face furnace water wall panels to be one body construction;

lifting two opposite face furnace water wall panels after the completion of the pre-assembling and suspending them temporarily in position;

lifting two other opposite face furnace water wall panels after the completion of pre-assembly;

moving all the four face furnace water wall panels to the designated positions; and connecting an upper portion of each face of said furnace water wall panel with a lower portion of the upper portion of the boiler proper that is formed by said four face furnace water wall panels being connected while the upper portion of the boiler proper is suspended within the boiler frame, wherein a lifting jack is located on the top of said boiler frame, the lifting jack simultaneously hanging the upper portions of the furnace water wall panels and dragging the lower portions on the ground and lifting the lower portions into position.

11. The method of claim 10 wherein left and right face furnace water wall panels within said four face furnace water wall panels are temporarily suspended in advance, the upper portion of the boiler proper is assembled while it is suspended from said top girder module beam module placed on top of said boiler frame, a furnace front wall and a furnace rear wall of the lower portion of boiler proper are suspended sequentially, said left and right face furnace water wall panels temporarily suspended are moved to designated positions, and the upper portion of each face of said furnace water wall panels and the lower portion of the upper portion of the boiler proper is connected.

12. The method of claim 10 wherein buckstays and a wind box to be attached to the furnace water wall panels are assembled together when each of said furnace water wall panels are formed.

13. The method of claim 10 wherein a pendant coil to be positioned immediately above a furnace rear wall among said furnace water wall panels is pulled up together with said furnace rear wall with said lifting jack at the same time.

14. The method of claim 10 wherein said lower portion of the boiler proper comprises a pair of left and right furnace water wall panels, a furnace front wall, a furnace rear wall and furnace hopper walls.

15. The method of claim 10 further comprising moving a pair of furnace hopper walls sequentially and forming said hopper portion.

16. The method of claim 15 wherein a pendant coil to be positioned immediately above a furnace rear wall among said furnace water wall panels is pulled up together with said furnace rear wall with said lifting jack at the same time.

17. The method of claim 16 wherein said lower portion of the boiler proper comprises a pair of left and right furnace water wall panels, a furnace front wall, a furnace rear wall and furnace hopper walls.

* * * * *

UNITED STATES PATENT AND TRADEMARK OFFICE

CERTIFICATE OF CORRECTION

PATENT NO. : 7,726,264 B2
APPLICATION NO. : 11/733377
DATED : June 1, 2010
INVENTOR(S) : Shigeyoshi Kawaguchi et al.

It is certified that error appears in the above-identified patent and that said Letters Patent is hereby corrected as shown below:

Please correct the Title Page, Assignee as follows:

(73) Assignee: Babcock-Hitachi Kabushiki Kaisyo, Tokyo (JP)

Signed and Sealed this
Fourteenth Day of August, 2012

David J. Kappos

David J. Kappos
*Director of the United States Patent and Trademark Office*